US009306275B2

(12) United States Patent
Mikata

(10) Patent No.: US 9,306,275 B2
(45) Date of Patent: Apr. 5, 2016

(54) MULTI-ANTENNA AND ELECTRONIC DEVICE

(71) Applicant: TAIYO YUDEN CO., LTD., Tokyo (JP)

(72) Inventor: Jin Mikata, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 210 days.

(21) Appl. No.: 13/849,241

(22) Filed: Mar. 22, 2013

(65) Prior Publication Data

US 2013/0271339 A1 Oct. 17, 2013

(30) Foreign Application Priority Data

Apr. 17, 2012 (JP) ..... 2012-093974

(51) Int. Cl.

| | |
|---|---|
| ***H01Q 1/38*** | (2006.01) |
| ***H01Q 21/00*** | (2006.01) |
| ***H01Q 1/50*** | (2006.01) |
| ***H01Q 1/24*** | (2006.01) |
| ***H01Q 9/42*** | (2006.01) |
| ***H01Q 21/28*** | (2006.01) |

(52) U.S. Cl.
CPC ..... *H01Q 1/50* (2013.01); *H01Q 1/243* (2013.01); *H01Q 9/42* (2013.01); *H01Q 21/28* (2013.01)

(58) Field of Classification Search
USPC ..... 343/700 MS, 702, 833, 834, 835
See application file for complete search history.

(56) References Cited

U.S. PATENT DOCUMENTS

| | | | | |
|---|---|---|---|---|
| 7,589,680 | B2 * | 9/2009 | Tsai et al. | 343/702 |
| 2007/0290927 | A1 | 12/2007 | Rowell et al. | |
| 2011/0122040 | A1 * | 5/2011 | Wakabayashi | 343/833 |
| 2012/0212389 | A1 * | 8/2012 | Aizawa et al. | 343/853 |
| 2012/0287012 | A1 * | 11/2012 | Aizawa | 343/853 |
| 2013/0257674 | A1 | 10/2013 | Li et al. | |
| 2014/0085164 | A1 * | 3/2014 | Kashiwagi et al. | 343/893 |

FOREIGN PATENT DOCUMENTS

| | | | |
|---|---|---|---|
| JP | 2011-77608 | A | 4/2011 |
| JP | 2011-109547 | A | 6/2011 |
| JP | 2013-214953 | A | 10/2013 |
| WO | 2010/006484 | A1 | 1/2010 |

OTHER PUBLICATIONS

Japanese Office Action dated Apr. 30, 2014, in a counterpart Japanese patent application No. 2012-093974.

* cited by examiner

*Primary Examiner* — Tan Ho
(74) *Attorney, Agent, or Firm* — Chen Yoshimura LLP

(57) ABSTRACT

A passive element has an electrical length such that a resonance mode thereof is in a target frequency band, and first and second feed elements, each of which has an electrical length such that a resonance mode thereof is not in the target frequency band. The first feed element has a first coupling conductive part, and a first connecting conductive part, which has a continuous shape with the first coupling conductive part. The second feed element has a second coupling conductive part, and a second connecting conductive part, which has a continuous shape with the second coupling conductive part. The first coupling conductive part is disposed parallel and adjacent to the passive element. The second coupling conductive part is disposed parallel and adjacent to the passive element. The first connecting conductive part and the second connecting conductive part are disposed adjacent and parallel to each other.

8 Claims, 37 Drawing Sheets

MULTI-ANTENNA AND ELECTRONIC DEVICE

This application claims the benefit of Japanese Application No. 2012-093974, filed in Japan on Apr. 17, 2012, which is hereby incorporated by reference in its entirety.

BACKGROUND OF THE INVENTION

1. Field of the Invention

The present invention relates to a multi-antenna and an electronic device used in wireless routers, mobile telephones, and the like.

2. Description of Related Art

The need for data communication for accessing the internet or the like using a mobile telephone is growing rapidly. Also, in recent years, household electric devices, other than mobile telephones, that have wireless communication systems have become more popular. In particular, devices provided with Bluetooth (trademark) or wireless LANs have become popular.

A diversity antenna has been used conventionally as a method for using a plurality of antennas in order to attain excellent communication sensitivity while conducting high speed transmission. The diversity antenna automatically selects a signal from an antenna among a plurality of antennas that has the greatest output. As a result, it became possible to conduct excellent communication compared to a case in which only one antenna is used, thus attaining a higher speed data transmission.

Recently, besides the diversity antenna, a modulation method known as an MIMO (multiple-input and multiple-output) communication system for conducting even faster communication has rapidly grown in use. The MIMO technique is provided with a plurality of antennas on both the transmitting side and the receiving side, and by attaining a transmission path that has been spatially multiplexed, the transmission capacity can be increased, thus increasing the communication speed. The MIMO technique is used in the following communication standards, for example.

For wireless LANs, the IEEE 802.11g standard has been established, and devices such as wireless LAN routers that follow this standard have become popular.

Mobile telephones that can conduct high speed data transmission according to the LTE (long term evolution) standard are starting to become popular.

Up until the present, internet connection was done by constructing communication lines (electrical wires or optical cables) from a server to each household, company, or the like, but WiMAX (IEEE 802.16e) has been established as a standard for converting this to wireless. As a result, internet connection infrastructure can be provided with ease to regions and the like with low populations. Also, in recent years, WiMAX has started to be used with mobile devices.

As wireless techniques that use a plurality of antennas such as diversity antennas or MIMO become popular, antennas for mobile devices with a small size, maximum isolation properties, and high efficiency are desired.

Patent Document 1 discloses an antenna device that is provided with a monopole passive element on one surface of an insulating substrate, two monopole antenna elements provided on the other surface with a gap therebetween, and a ground pattern for each monopole between the antenna elements.

In this antenna device, the two antennas have opposite directionalities to each other by disposing the ground pattern between the two antenna elements, which improves isolation properties.

Patent Document 2 discloses a multi-antenna device provided with a passive element between two monopole antenna elements such that a current generated by capacitive coupling flows in the opposite direction to the current flowing to these elements.

This multi-antenna device has improved isolation by reducing mutual coupling to the element between the antenna elements by providing a passive element of the above configuration therebetween.

RELATED ART DOCUMENTS

Patent Documents

Patent Document 1: Japanese Patent Application Laid-Open Publication No. 2011-77608

Patent Document 2: Japanese Patent Application Laid-Open Publication No. 2011-109547

SUMMARY OF THE INVENTION

Mutual coupling between the antenna elements occurs with the techniques disclosed in both Patent Document 1 and Patent Document 2, which results in loss.

Also, the techniques disclosed in Patent Document 1 and Patent Document 2 both have space loss due to the need to interpose a ground pattern and a passive element between the antenna elements.

Considering the above situation, an object of the present invention is to provide a multi-antenna and an electronic device that can achieve high isolation properties without relying on space and are highly efficient.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present invention provides a multi-antenna that includes: a passive element with an electrical length such that a resonance mode thereof is in a target frequency band; and first and second feed elements, each of the first and second feed elements having an electrical length such that a resonance mode is not in the target frequency band, the first and second feed elements being capacitively coupled with the passive element.

In another aspect, the present invention provides a multi-antenna that includes: a first passive element with an electrical length such that a resonance mode thereof is in a first target frequency band;

a second passive element with an electrical length such that a resonance mode is in a second target frequency band; and first and second feed elements, each of the first and second feed elements having an electrical length such that a resonance mode thereof is not in the first or second target frequency band and being capacitively coupled with the first and second passive elements.

In another aspect, the present invention provides an electronic device that includes:

a multi-antenna having a passive element at an electrical length such that a resonance mode thereof is in a target frequency band, and first and second feed elements, each of which has an electrical length such that a resonance mode thereof is not in the target frequency band, each of the first and second feed elements being capacitively coupled with the passive element; and a high frequency circuit connected to the first and second feed elements.

According to the present invention, the first and second feed elements have electrical lengths such that a resonance mode is not in the target frequency band, and thus, high isolation properties can be achieved without relying on space and a high efficiency can be attained.

It is to be understood that both the foregoing general description and the following detailed description are exemplary and explanatory, and are intended to provide further explanation of the invention as claimed.

DETAILED DESCRIPTION OF THE PREFERRED EMBODIMENTS

Figure 1:
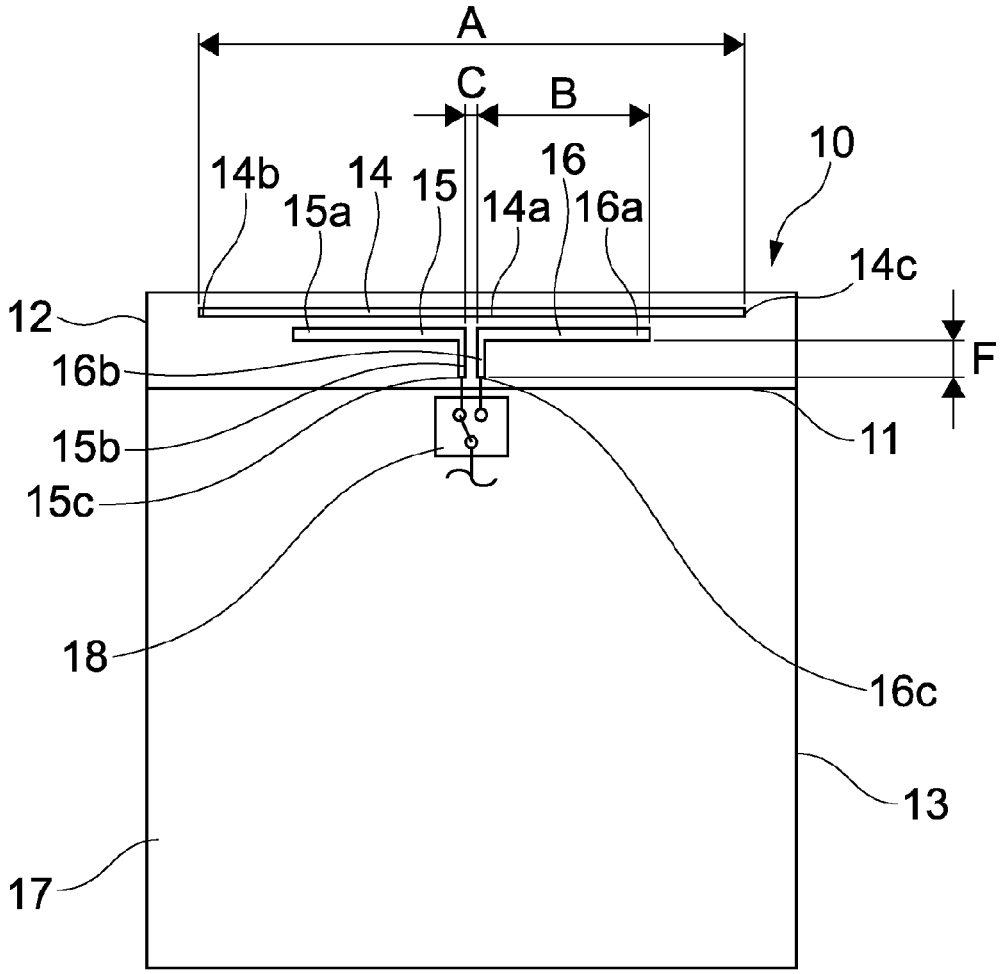
FIG. 1 is a plan view that shows a configuration of a multi-antenna according to Embodiment 1 of the present invention.

In order to achieve the above-mentioned object, a multi-antenna according to one embodiment of the present invention has a passive element, a first feed element, and a second feed element.

The passive element has an electrical length such that the resonance mode thereof is in a target frequency band.

The first and second feed elements each have an electrical length such that a resonance mode thereof is not in the target frequency band, and capacitively couple with the passive element.

In a multi-antenna according to one embodiment of the present invention, the first and second feed elements have electrical lengths such that a resonance mode thereof is not in the target frequency band, and thus, one feed element is not excited by a radio wave emitted by the other feed element. Therefore, the presence of one feed element does not result in loss in the other feed element, and thus high isolation properties can be achieved. Also, a gap between the first feed element and the second feed element is no longer relevant for isolation, and thus, it is possible to dispose the first feed element and the second feed element so as to be adjacent to each other, for example. Therefore, the multi-antenna according to the present embodiment can achieve high isolation properties without relying on space.

In the above-mentioned multi-antenna, it is preferable that the passive element be a non-ground type, that the first feed element include a first coupling conductive part and a first connecting conductive part that is continuous to the first coupling conductive part and connected to a first feed point, the first coupling conductive part being capacitively coupled with the passive element and meeting at an angle with a first connecting conductive part, and that the second feed element include a second coupling conductive part and a second connecting conductive part that is continuous to the second coupling conductive part and connected to a second feed point, the second coupling conductive part being capacitively coupled with the passive element in a location different from the capacitive coupling of the first connecting conductive part and meeting at an angle with a second connecting conductive part disposed adjacent to the first connecting conductive part.

In the above embodiment, by making the passive element a non-ground type, the passive element is no longer relevant to the ground pattern, thus increasing the design flexibility. In other words, if the passive element is a ground type, it would be necessary to provide paths such as wiring line patterns and through holes for connecting the passive element to the ground pattern between the passive element and the ground pattern, and thus, due to restrictions by the paths, the design flexibility of the wiring lines for the feed element and the like would be lessened. By contrast, if the passive element is a non-ground type, such paths are no longer necessary, and thus, the design flexibility is increased. Also, in the present embodiment, the first connecting conductive part and the second connecting conductive part are disposed adjacent to each other, and thus, it is possible to dispose the feed points thereof in locations adjacent to each other. Therefore, it is possible to shorten the wiring lines connecting the switching element for diversity and respective feed points, for example, and there are less cases of noise traveling from these wiring lines to various circuits.

In the above-mentioned multi-antenna, it is preferable that the passive element be a line-shaped conductor, and that, in the first and second feed elements, the first coupling conductive part be connected to the first connecting conductive part adjacent to a center of the passive element and disposed so as to be parallel to the passive element from the above-mentioned center towards a first end of the passive element, and that the second coupling conductive part be connected to the second connecting conductive part adjacent to the above-mentioned center of the passive element and disposed so as to be parallel to the passive element from the above-mentioned center towards a second end of the passive element, the first connecting conductive part and the second connecting conductive part being disposed so as to be adjacent and parallel to each other and being at the above-mentioned angle respectively to the first coupling conductive part and the second coupling conductive part.

In this embodiment, the passive element is a line-shaped conductor and the first and second coupling conductive parts are disposed so as to be parallel to the passive element, and thus, it is possible to dispose all or most of these elements in a limited region in the edge along one side of a rectangular substrate on which these elements are mounted. Also, by disposing the first coupling conductive part and the second coupling conductive part so as to extend towards both respective ends from the center of the passive element, it is possible to have a bilaterally symmetrical configuration, and the performance of each feed element can be understood with ease.

The above-mentioned multi-antenna preferably includes a rectangular substrate with the passive element mounted thereon, and it is preferable that the passive element be disposed such that the center thereof is located adjacent to a first corner of the rectangular substrate, and such that the passive element has a first part parallel to a first side of the substrate and a second part parallel to a second side that intersects orthogonally with the first side, the first coupling conductive part be disposed so as to be parallel to the first side of the substrate, and the second coupling conductive part be disposed so as to be parallel to the second side of the substrate.

In the present embodiment, by disposing a multi-antenna so as to be concentrated in the corner of the substrate, it is possible to reduce the amount of space used. Also, because the multi-antenna has a polarization surface where the first feed element and the second feed element intersect orthogonally, it is possible to attain polarization diversity or polarized MIMO effects.

A multi-antenna according to another embodiment of the present invention has a first passive element, a second passive element, a first feed element, and a second feed element. The first passive element has an electrical length such that a resonance mode thereof is in the first target frequency band, and the second passive element has an electrical length such that a resonance mode thereof is in the second target frequency band.

The first and second feed elements have electrical lengths such that resonance modes thereof are not in the first or second target frequency band, and can respectively be capacitively coupled with the first and second passive elements.

The multi-antenna of this embodiment can achieve high isolation properties without relying on space over a dual band.

It is preferable that the above-mentioned multi-antenna further include a substrate that has the first passive element and the first and second feed elements mounted on a first surface thereof, and has the second passive element mounted on a second surface thereof.

In the present embodiment, the dual band multi-antenna can achieve high isolation properties, and furthermore can be disposed in a space-efficient manner.

An electronic device according to an embodiment of the present invention has a multi-antenna and a high frequency circuit.

The multi-antenna has a passive element with an electrical length such that a resonance mode thereof is in a target frequency band, and first and second feed elements, each of which has an electrical length such that a resonance mode thereof is not in a target frequency band, each of the first and second feed elements being capacitively coupled with the passive element.

The high frequency circuit is connected to the first and second feed elements.

Because the electronic device according to one embodiment of the present invention has a multi-antenna that can achieve high isolation properties without relying on space, the device can be miniaturized and the transmitting and receiving performance are also high.

<Embodiment 1>

Embodiments of the present invention will be described below with reference to the drawings.

FIG. 1 is a plan view that shows a multi-antenna according to Embodiment 1 of the present invention.

As shown in FIG. 1, the multi-antenna 10 has a substrate 11. The substrate 11 is rectangular and has an antenna disposal region 12 and a ground pattern disposal region 13 on a first surface. A passive element 14, a first feed element 15, and a second feed element 16 are disposed in the antenna disposal region 12. A ground pattern 17 and a switch element 18 are disposed in the ground pattern disposal region 13.

The passive element 14 is a non-ground type line-shaped element with an electrical length such that a resonance mode thereof is in a target frequency band. Here, an example of using 2.45 GHz, which is the frequency used in a wireless LAN, is described.

The passive element 14 is an element with an electrical length of (½)·λ, where the λ is the wavelength of the target frequency band. If the target frequency band is 2.45 GHz, the length of the passive element 14 is 44 mm. However, the wavelength shortening ratio, which is a parameter for electrical length, differs depending on various conditions, and thus, it is not possible to define a fixed value for the electrical length. The passive element 14 is disposed along one edge of the substrate 11. In the present invention, even if the passive element 14 is a flat antenna formed on the substrate as stated above, the passive element 14 in reality functions as a line-shaped element, and thus, even with such a shape, it is referred to as a line-shaped element.

The first feed element 15 and the second feed element 16 are also line-shaped elements. The first feed element 15 has a first coupling conductive part 15*a*, and a first connecting conductive part 15*b* with a continuous shape, forming an angle of 90°, for example, to the first coupling conductive part 15*a*. The second feed element 16 has a second coupling conductive part 16*a*, and a second connecting conductive part 16*b* with a continuous shape, forming an angle of 90°, for example, to the second coupling conductive part 16*a*. The ends of the first and second connecting conductive parts 15*b* and 16*b* are provided with feed points 15*c* and 16*c*, respectively.

The first coupling conductive part 15*a* is connected to the first connecting conductive part 15*b* at the center 14*a* of the passive element 14, and is disposed so as to be adjacent and parallel to the passive element 14 from the center 14*a* of the passive element 14 towards a first end 14*b* of the passive element 14. The second coupling conductive part 16*a* is connected to the second connecting conductive part 16*b* at the center 14*a* of the passive element 14, and is disposed so as to be adjacent and parallel to the passive element 14 from the center 14*a* of the passive element 14 towards a second end 14*c* of the passive element 14. The first connecting conductive part 15*b* and the second connecting conductive part 16*b* are disposed adjacent and parallel to each other.

The first coupling conductive part 15*a* and the second coupling conductive part 16*a* constitute a main part for capacitive coupling with the passive part 14. The first and second connecting conductive parts 15*b* and 16*b* mainly constitute feed lines between the feed points 15*c* and 16*c*, and the first coupling conductive part 15*a* and the second coupling conductive part 16*a*, respectively. The first and second feed elements 15 and 16 are capacitively coupled with the passive element 14 mainly at the first coupling conductive part 15*a* and the second coupling conductive part 16*a*, but have an electrical length such that a resonance mode thereof is not in the target frequency band. More specifically, the length of B+F is shorter than the electrical length of (¼)·λ, where B is the length of the first coupling conductive part 15*a*, and F is the length of the first connecting conductive part 15*b*. The same applies to the second feed element 16. For example, if the target frequency band is 2.45 GHz, then the first feed element 15 and the second feed element 16 are 18 mm, shorter than 22 mm.

The ground pattern 17 disposed in the ground pattern disposal region 13 functions as a ground for the multi-antenna 10. Also, the switch element 18 is an element for selecting either the first feed element 15 or the second feed element 16, and diversity function can be achieved as a result of the switch element 18, for example. FIG. 1 schematically shows the switch element 18. The multi-antenna 10 according to the present embodiment can be manufactured with ease by etching, for example, except for the switch element 18.

In the multi-antenna 10 according to the present embodiment, high isolation properties can be achieved, and the multi-antenna 10 is highly efficient.

Figure 2:
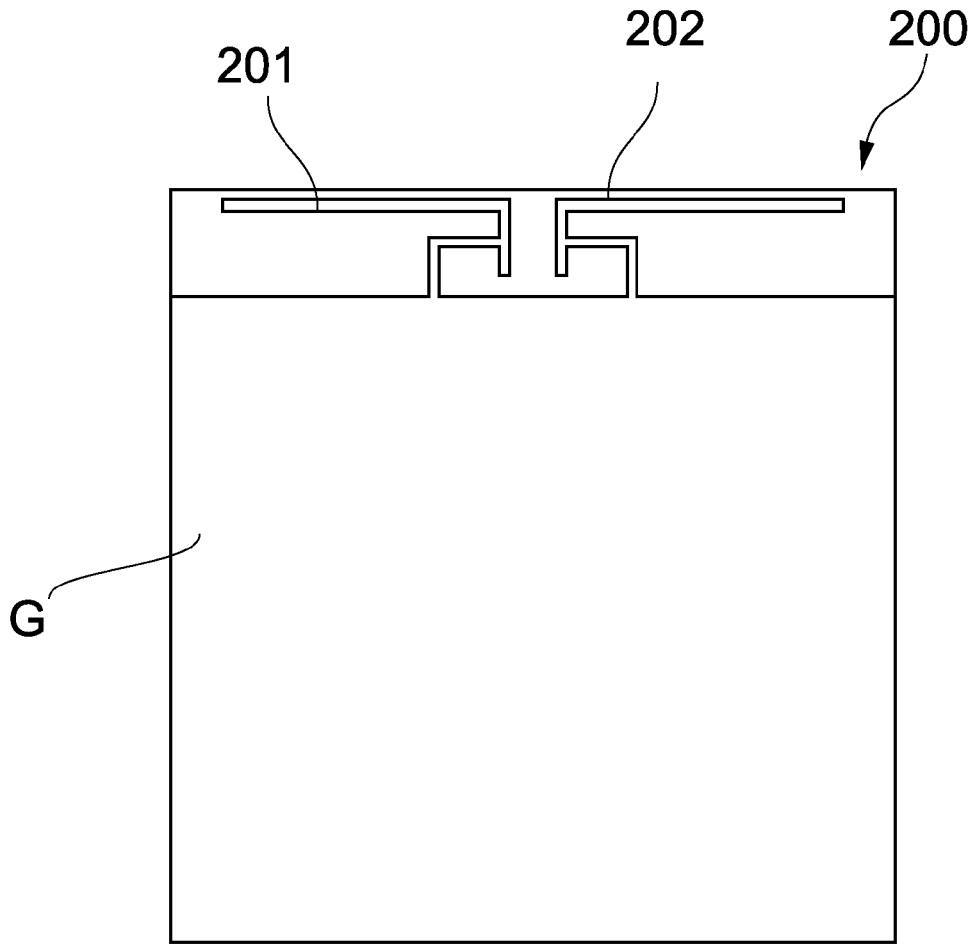
FIG. 2 is a plan view for showing a configuration of an antenna for comparison.

FIG. 2 shows an antenna 200 as a comparison example that is provided with reverse F antennas 201 and 202, arranged in a manner similar to the present embodiment, with an electrical length ((¼)·λ), which causes a resonance mode in the target frequency band.

Figure 3:
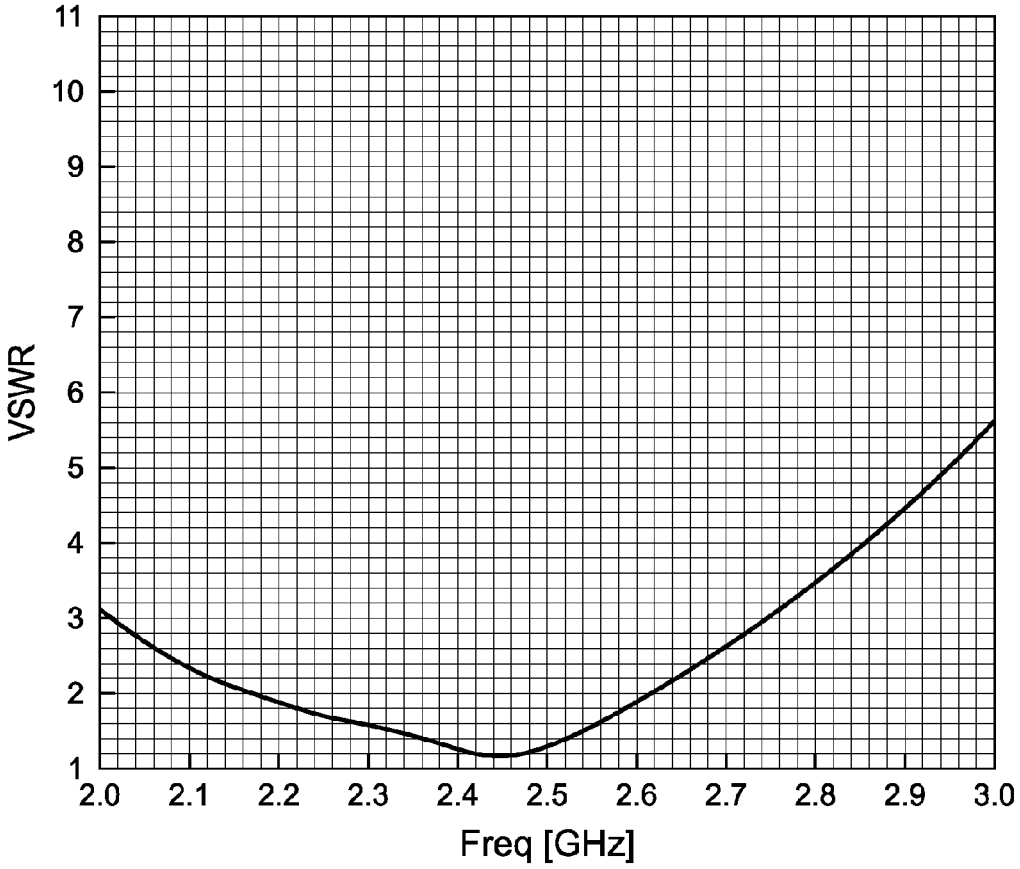
FIG. 3 shows simulation results of VSWR properties in the multi-antenna shown in FIG. 1.
Figure 4:
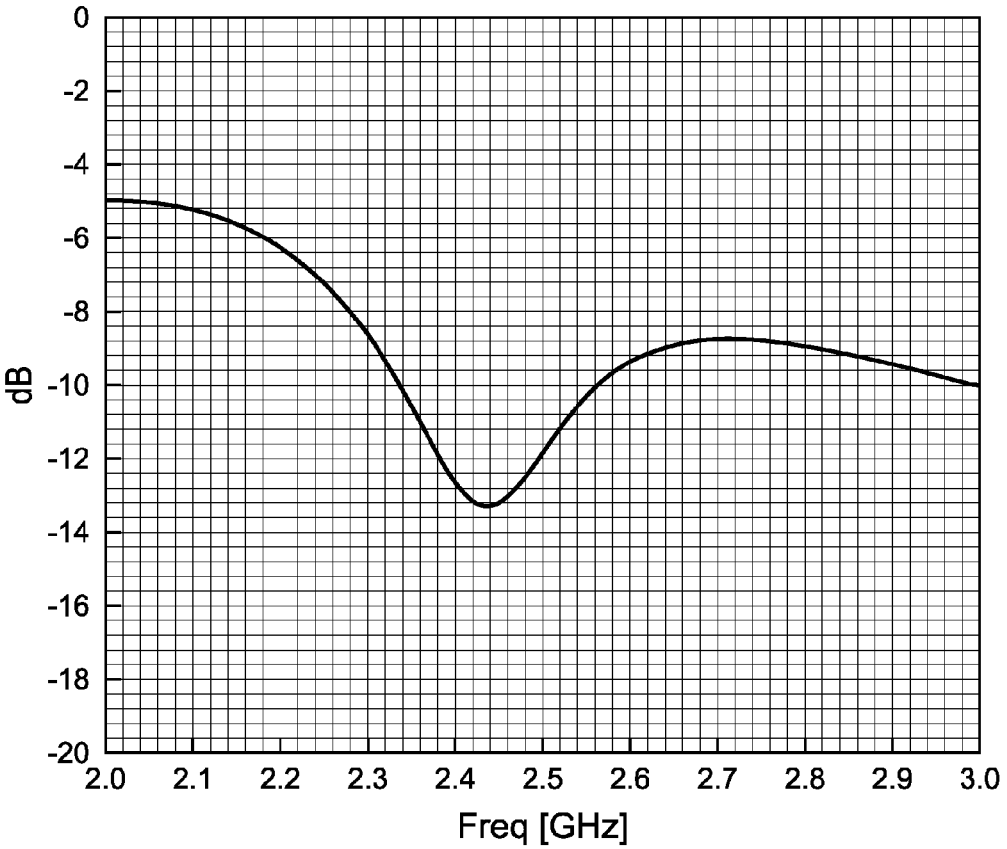
FIG. 4 shows simulation results of isolation in the multi-antenna shown in FIG. 1.
Figure 5:
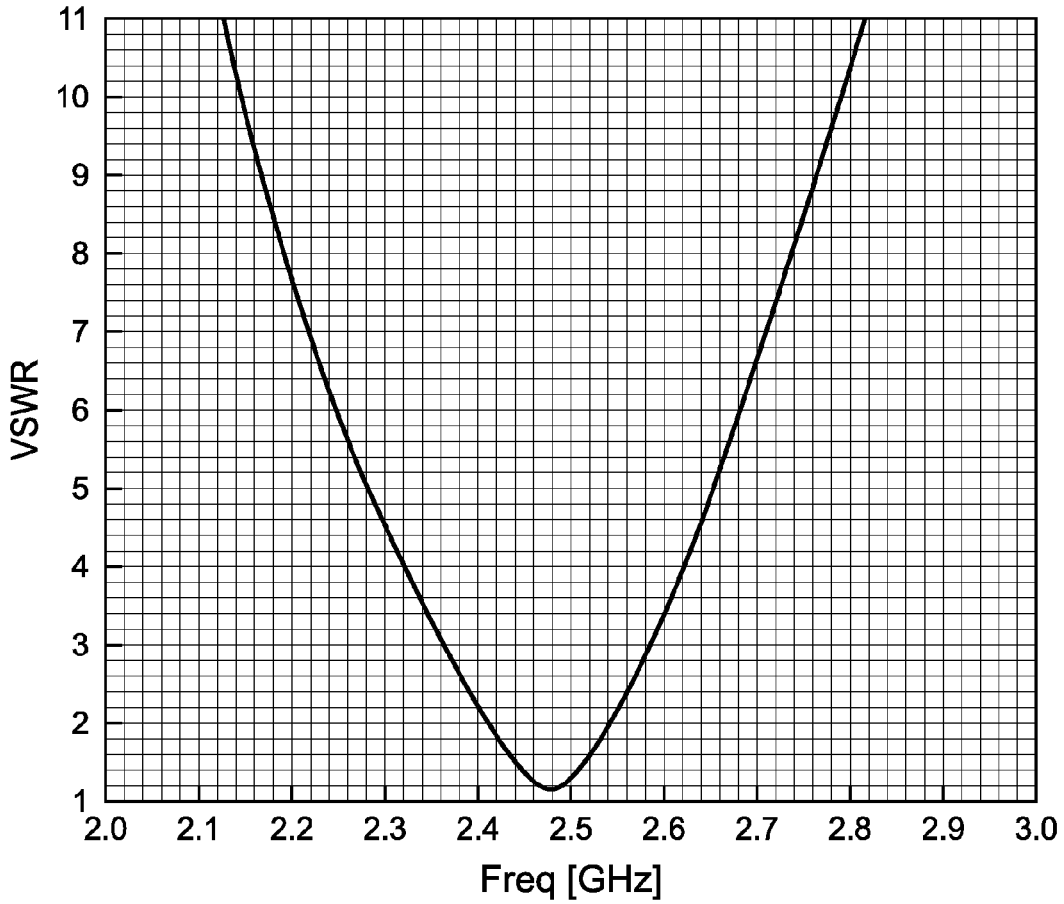
FIG. 5 shows simulation results of VSWR properties in the antenna shown in FIG. 2.
Figure 6:
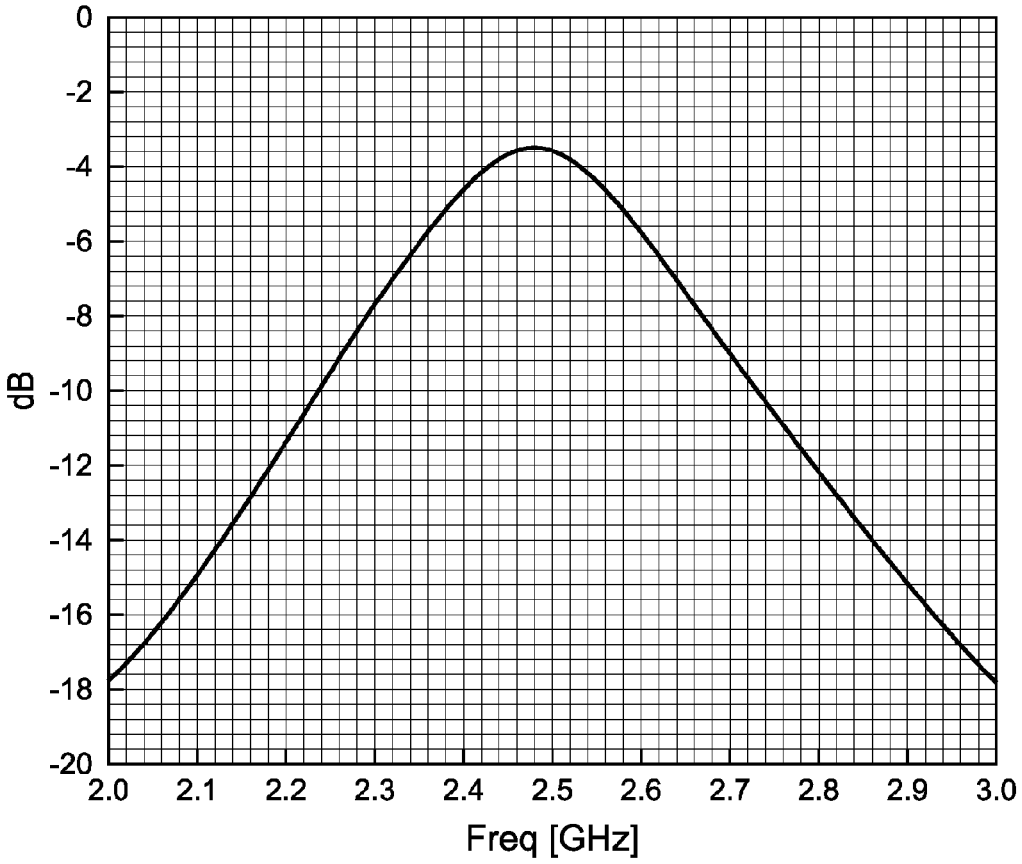
FIG. 6 shows simulation results of isolation in the antenna shown in FIG. 2.

The simulation results of the VSWR properties and isolation of the multi-antenna 10 according to the present embodiment are respectively shown in FIGS. 3 and 4. Here, A=44.0 mm, B=11.0 mm, and C=4.5 mm. Also, the simulation results of the VSWR properties and isolation of the antenna 200 shown in FIG. 2 are respectively shown in FIGS. 5 and 6. Both antennas are for wireless LAN routers configured to operate at 2.45 GHz.

As can be seen from FIGS. 3 and 4, the multi-antenna 10 according to the present embodiment has excellent VSWR properties, and furthermore, has low values in the entire 2.4 to 2.5 GHz range, which is the wireless LAN band. Also, isolation is maintained at 12 dB in the aforementioned frequency. Meanwhile, as can be seen from FIGS. 5 and 6, the antenna 200 as a comparison example has excellent VSWR properties, but the frequency band thereof is narrow, and the isolation is worse at 3.6 dB, which results in an antenna with increased loss and lower transmitting efficiency.

Figure 7:
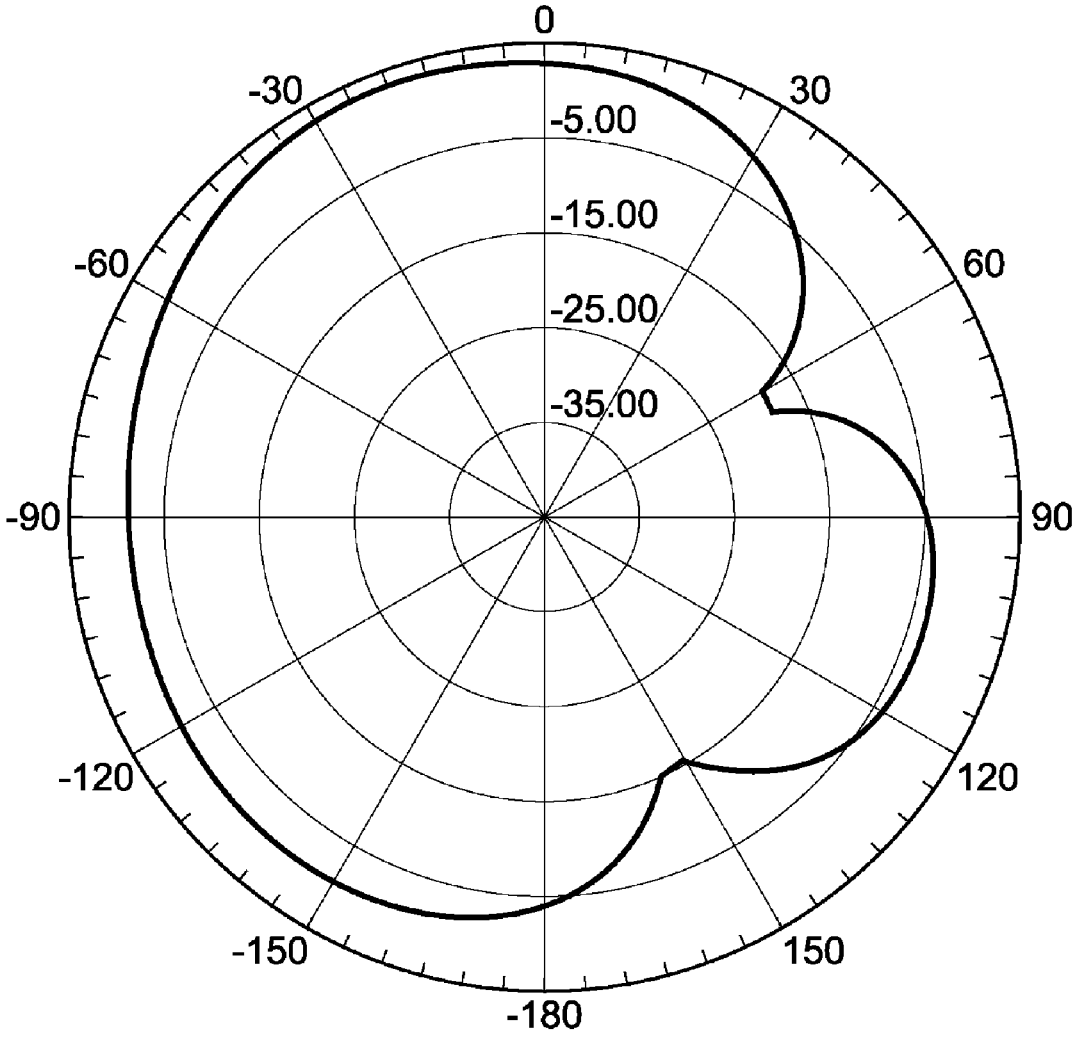
FIG. 7 shows simulation results (first feed element) for the directivity in the multi-antenna shown in FIG. 1.
Figure 8:
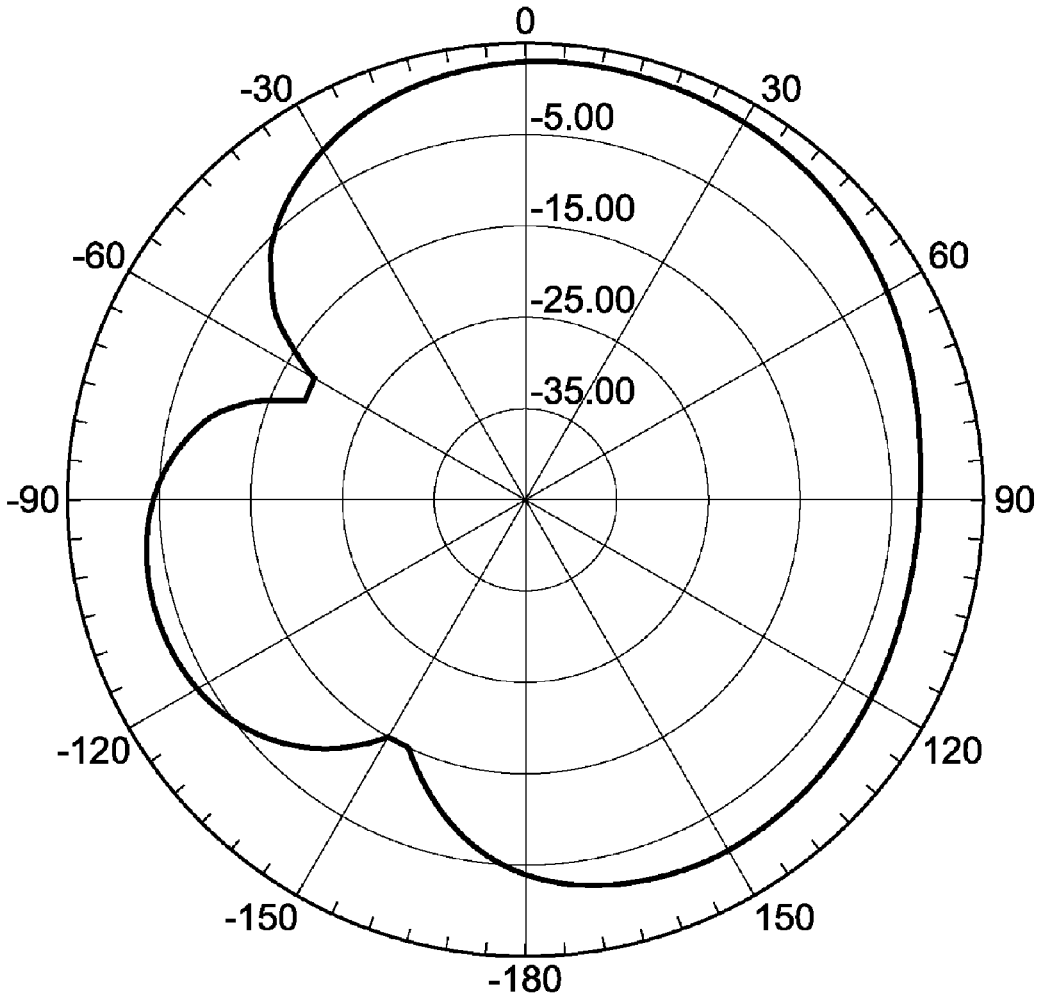
FIG. 8 shows simulation results (second feed element) for the directivity in the multi-antenna shown in FIG. 1.

Next, the simulation results for the directivity of the multi-antenna 10 according to the present embodiment are shown in FIGS. 7 and 8. FIG. 7 shows the directivity of the multi-antenna 10 when the first feed element 15 is driven and the second feed element 16 is not driven. Also, FIG. 8 shows the directivity of the multi-antenna 10 when the second feed element 16 is driven and the first feed element 15 is not driven. As can be seen from these drawings, the multi-antenna 10 has sufficient directivity, and thus, can be used as a directivity diversity antenna.

According to research conducted by the inventors of the present invention, by changing the parameters A, B, and C in the multi-antenna 10, it is possible to adjust not only the resonating frequency, but also the impedance and the isolation. As a result, the design flexibility of the antenna is improved, and it is possible to provide antennas with various functions depending on the needs.

Figure 9:
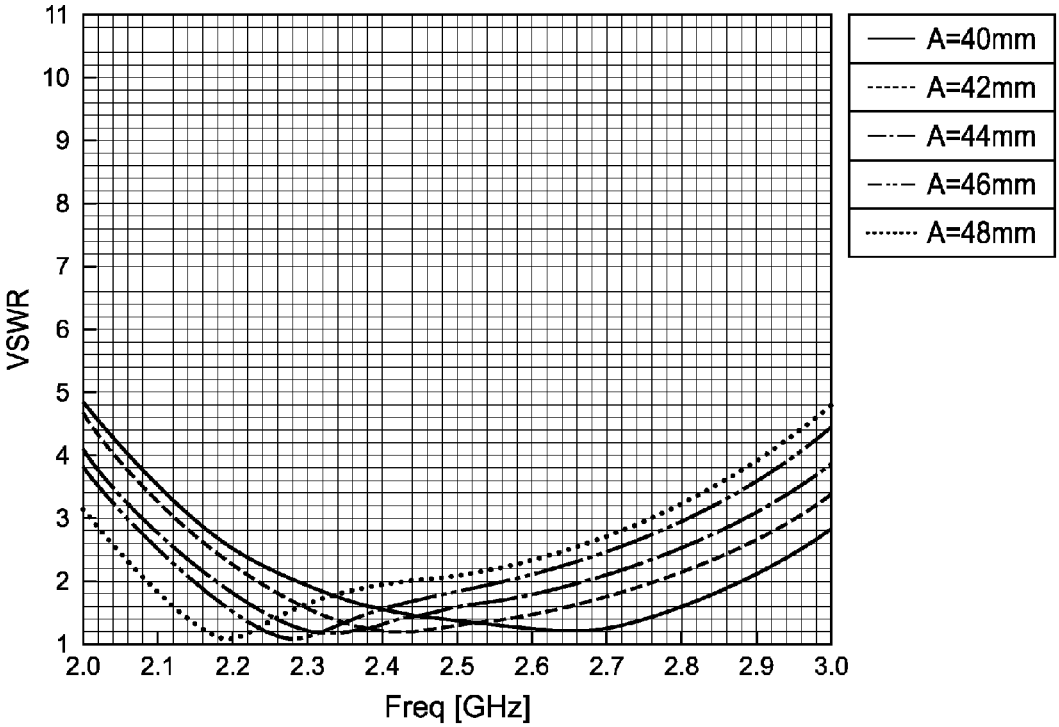
FIG. 9 shows simulation results of the difference in VSWR properties when A shown in FIG. 1 is changed.
Figure 10:
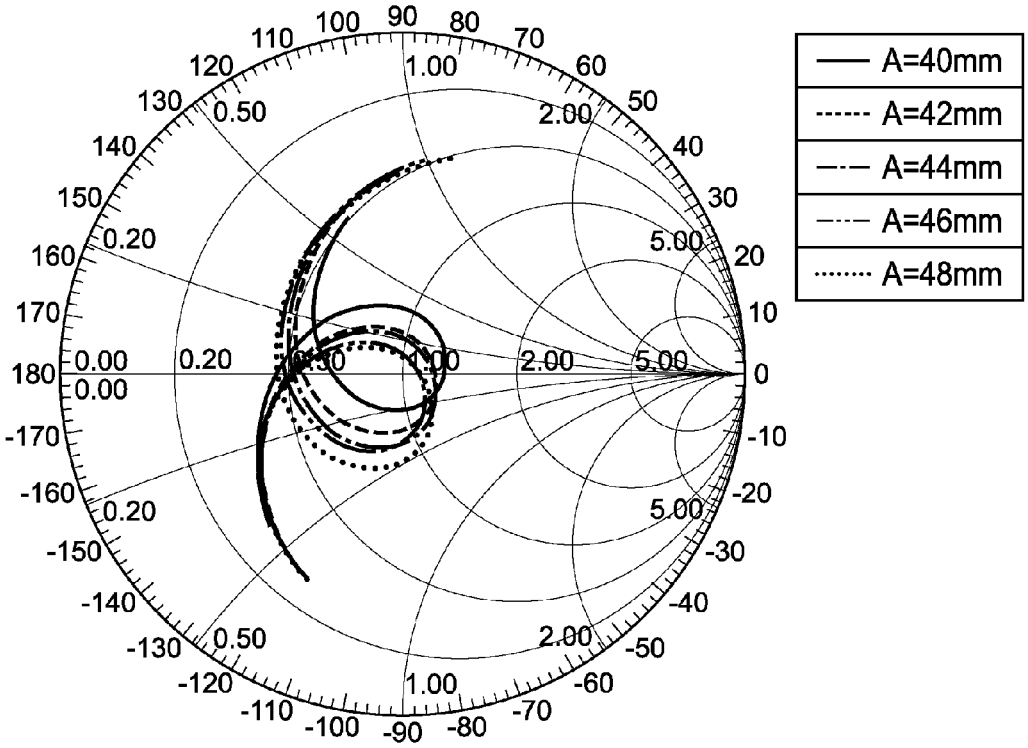
FIG. 10 shows simulation results of the difference in direction of impedance change when A shown in FIG. 1 is changed.
Figure 11:
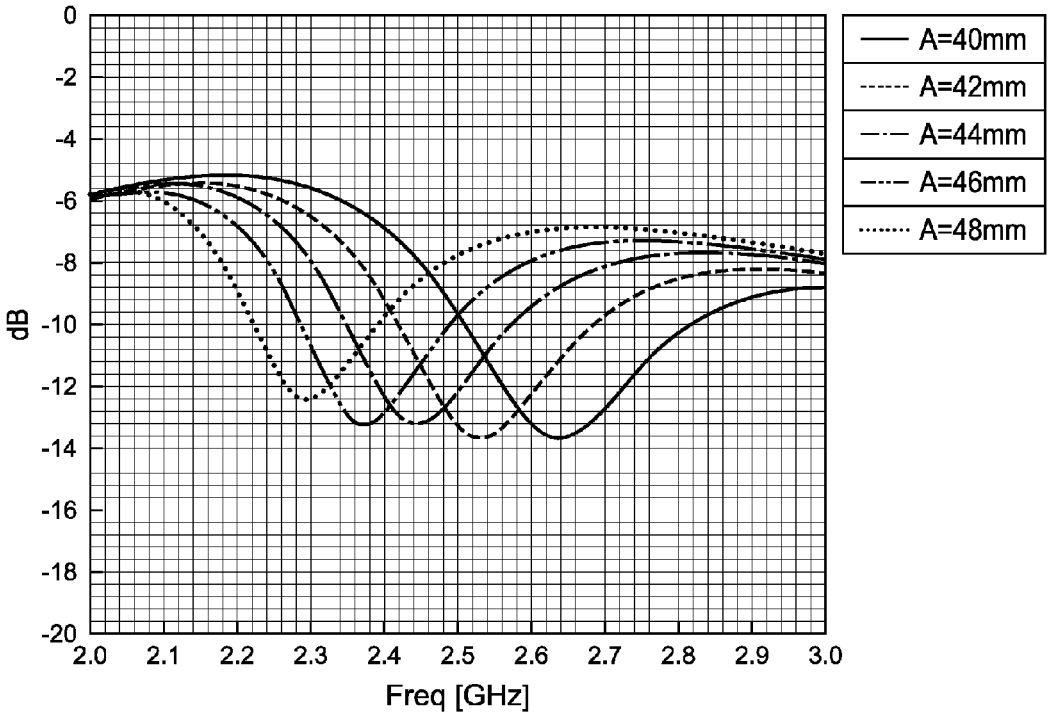
FIG. 11 shows simulation results of the difference in isolation when A shown in FIG. 1 is changed.
Figure 12:
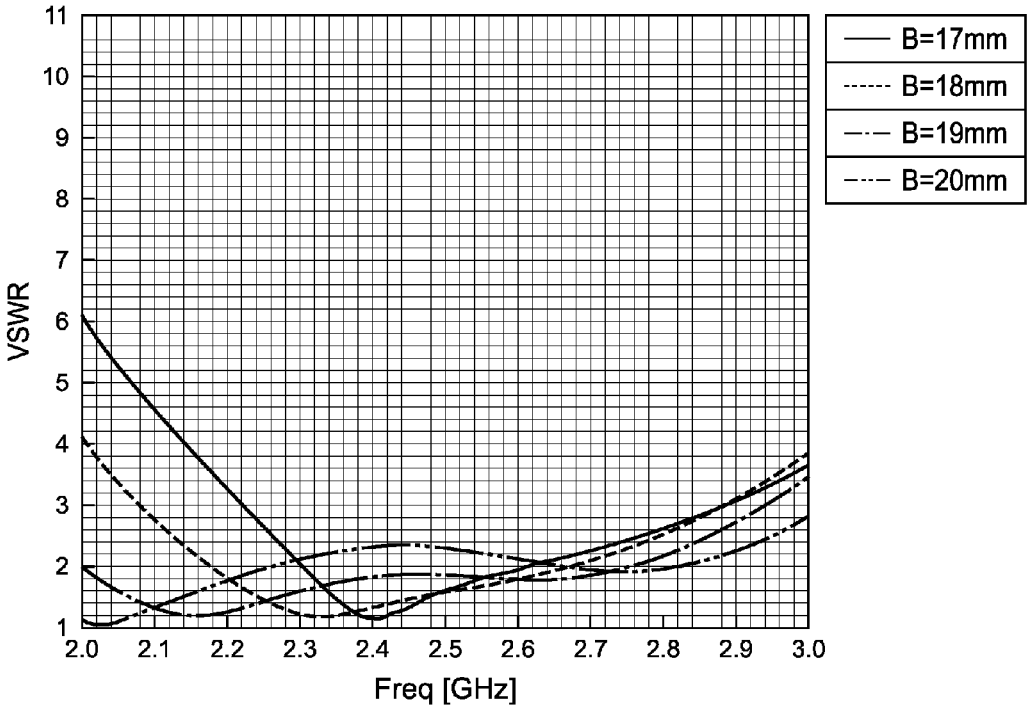
FIG. 12 shows simulation results of the difference in VSWR properties when B shown in FIG. 1 is changed.
Figure 13:
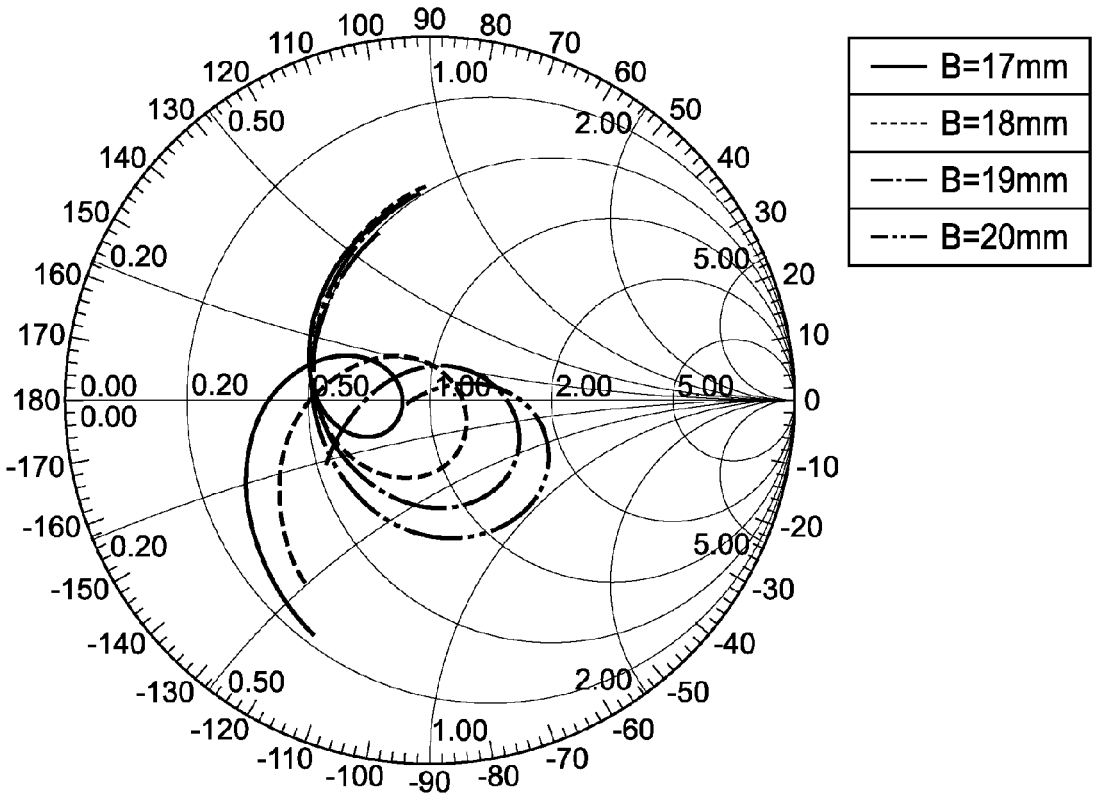
FIG. 13 shows simulation results of the difference in direction of impedance change when B shown in FIG. 1 is changed.
Figure 14:
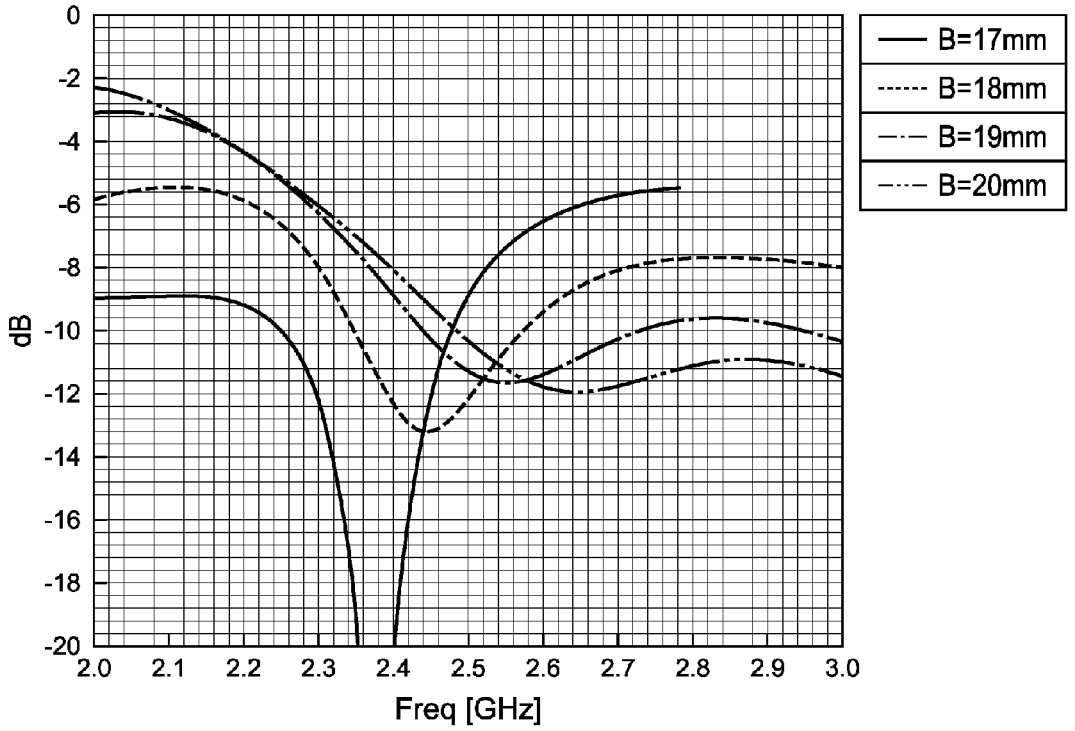
FIG. 14 shows simulation results of the difference in isolation when B shown in FIG. 1 is changed.
Figure 15:
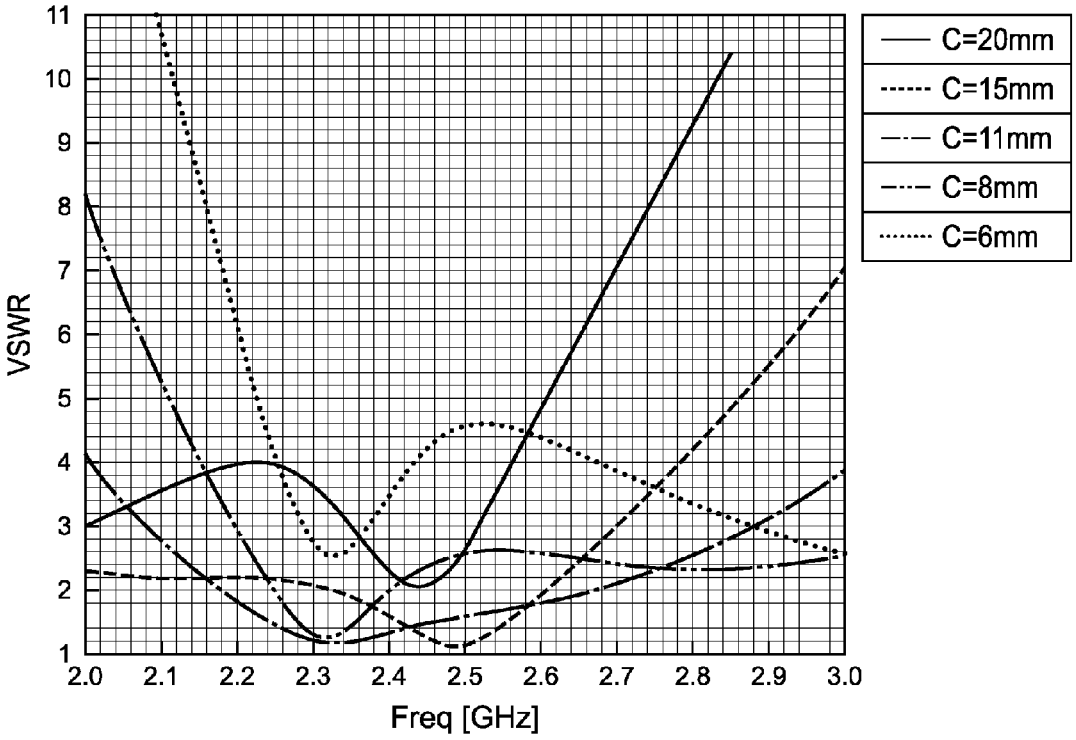
FIG. 15 shows simulation results of the difference in VSWR properties when C shown in FIG. 1 is changed.
Figure 16:
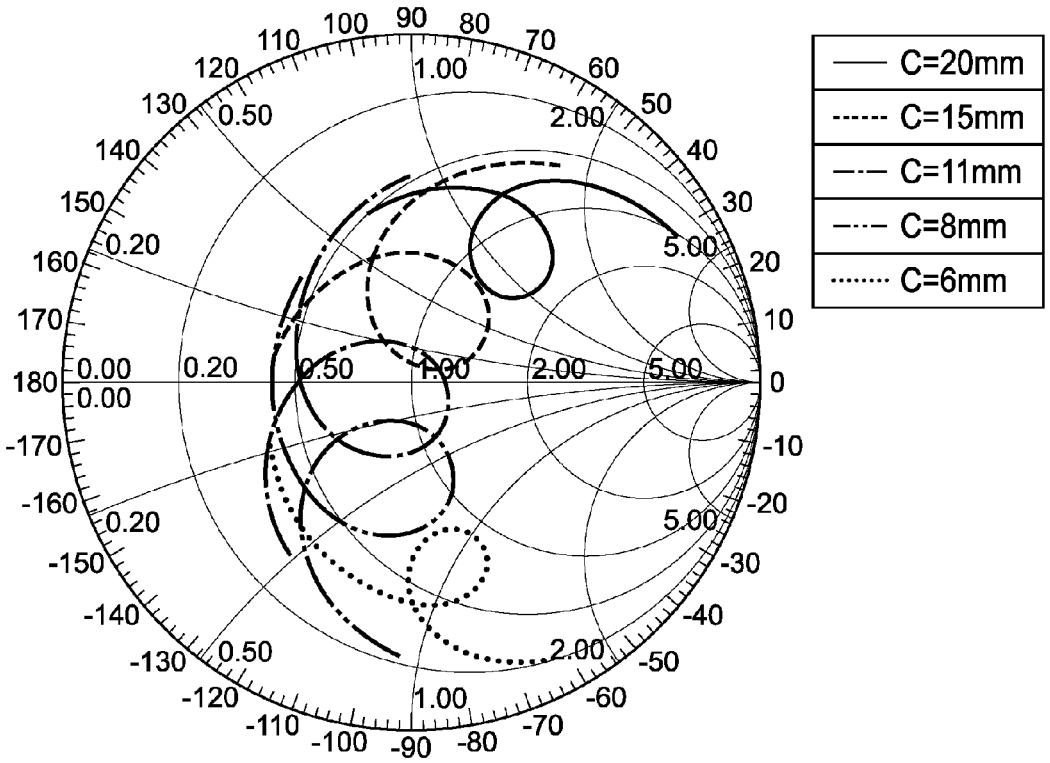
FIG. 16 shows simulation results of the difference in direction of impedance change when C shown in FIG. 1 is changed.
Figure 17:
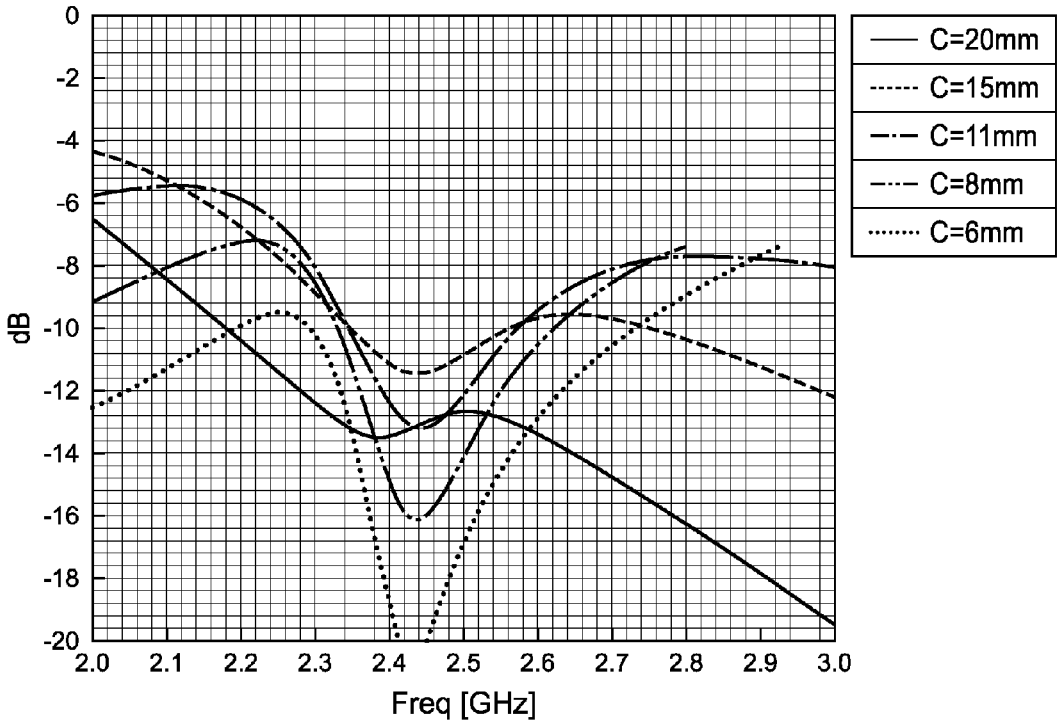
FIG. 17 shows simulation results of the difference in isolation when C shown in FIG. 1 is changed.

FIGS. 9 to 11 show the simulation results of differences in VSWR properties, the direction of impedance change, and isolation, when the value of A is changed. FIGS. 12 to 14 show the simulation results of differences in VSWR properties, the direction of impedance change, and isolation, when the value of B is changed. FIGS. 15 to 17 show the simulation results of differences in VSWR properties, the direction of impedance change, and isolation, when the value of C is changed.

As can be seen from these results, A determines the antenna resonating frequency. Therefore, a frequency at which isolation is adequate is also determined with this value. Also, impedance varies depending on B and C. Therefore, it is possible to configure an antenna in which impedance matching is unnecessary by selecting appropriate values for B and C.

Figure 18:
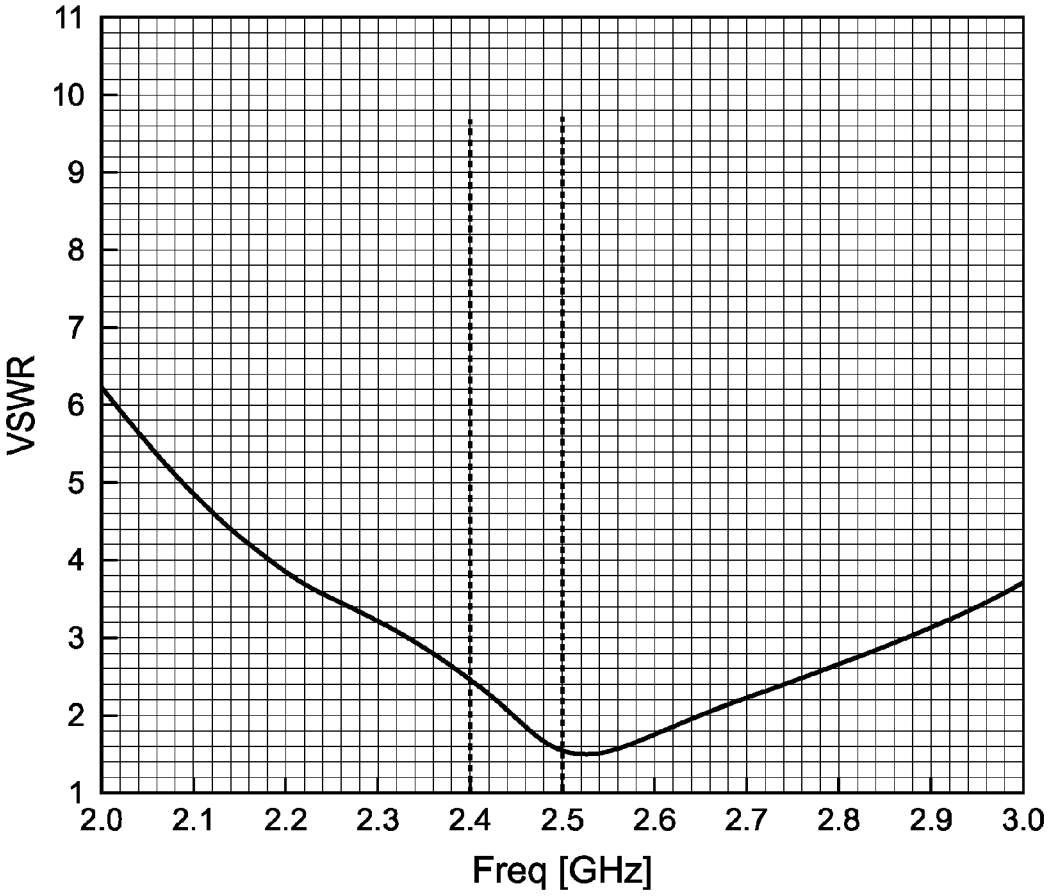
FIG. 18 shows simulation results of VSWR properties when C shown in FIG. 1 is further changed.
Figure 19:
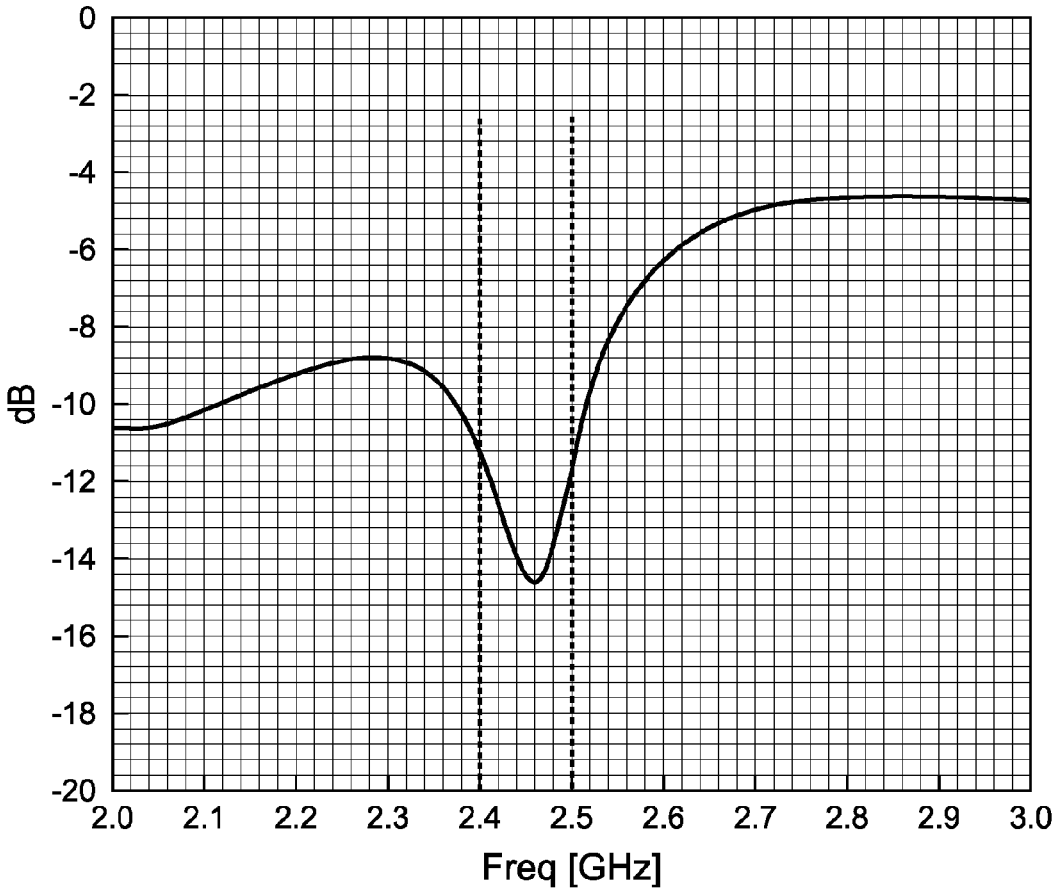
FIG. 19 shows simulation results of the isolation when C shown in FIG. 1 is further changed.
Figure 20:
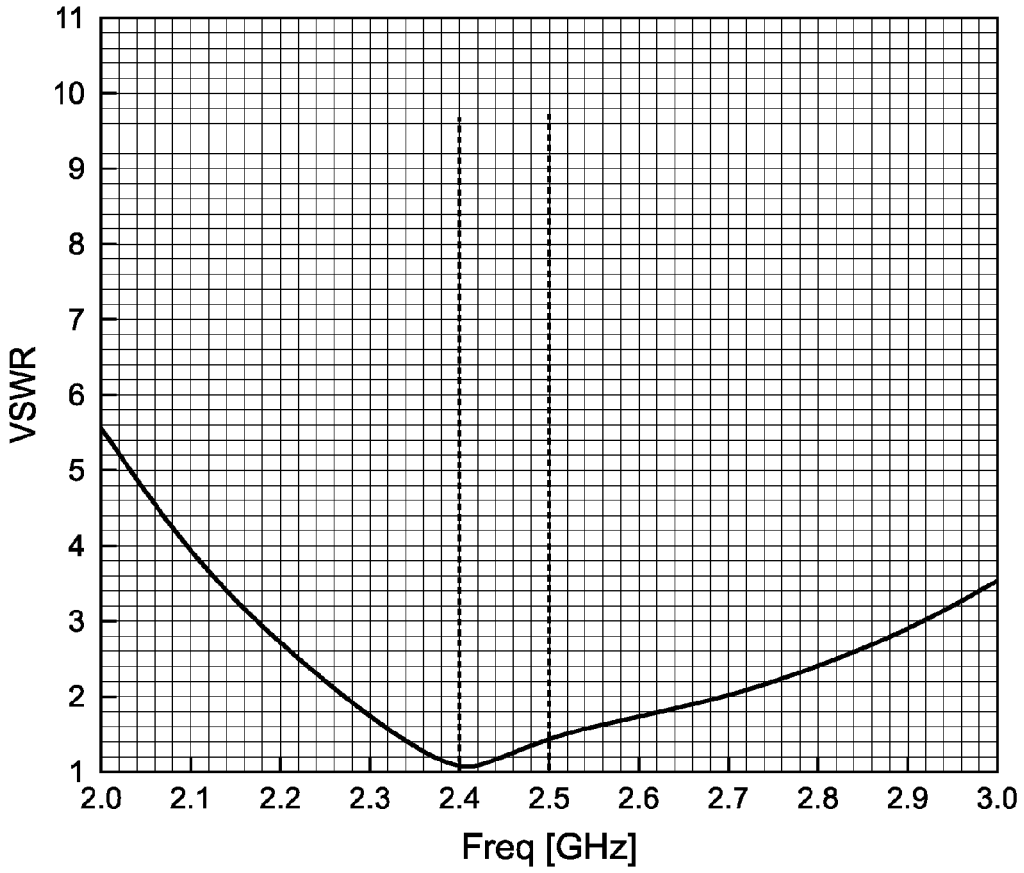
FIG. 20 shows simulation results of VSWR properties when C shown in FIG. 1 is further changed.
Figure 21:
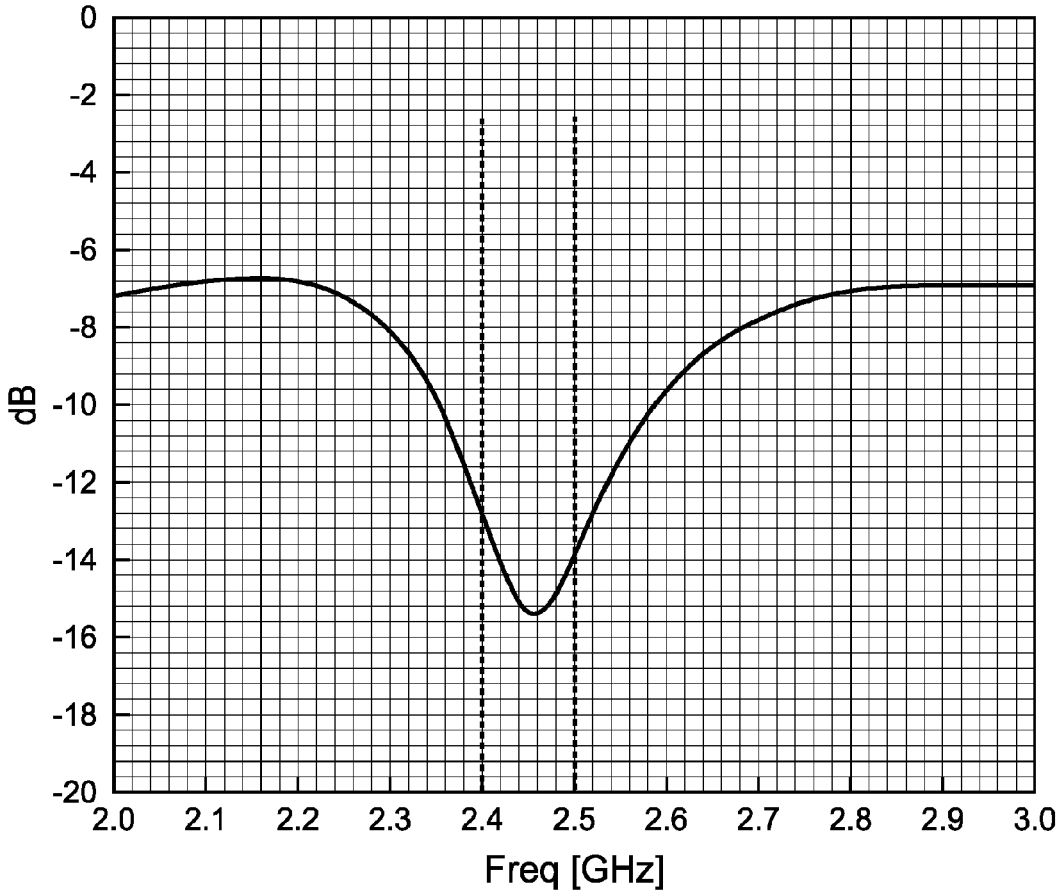
FIG. 21 shows simulation results of the isolation when C shown in FIG. 1 is further changed.

In addition, the inventors of the present invention studied the effect of C as a parameter. FIGS. 18 and 19 show the simulation results for the VSWR properties and isolation when C=1.5 mm, A=42.0 mm, and B=12.0 mm. FIGS. 20 and 21 show the simulation results for the VSWR properties and isolation when C=4.0 mm, A=43.0 mm, and B=10.3 mm.

Figure 22:
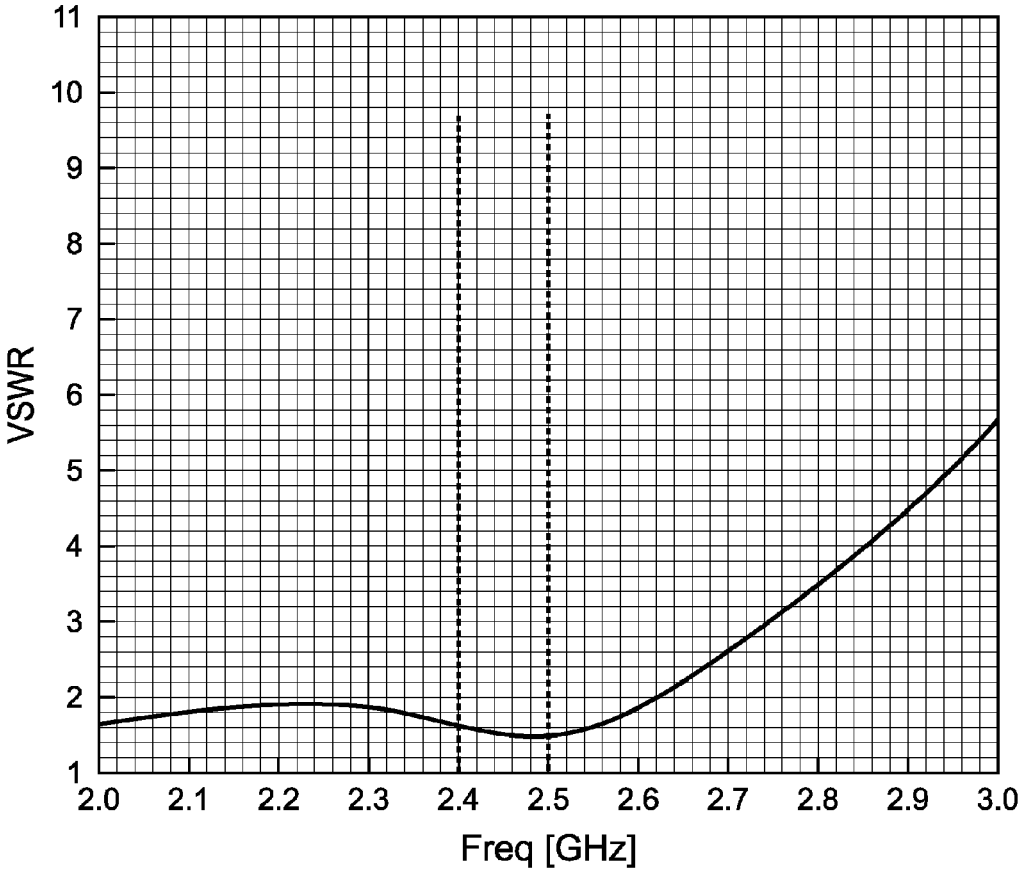
FIG. 22 shows simulation results of VSWR properties when C shown in FIG. 1 is further changed.
Figure 23:
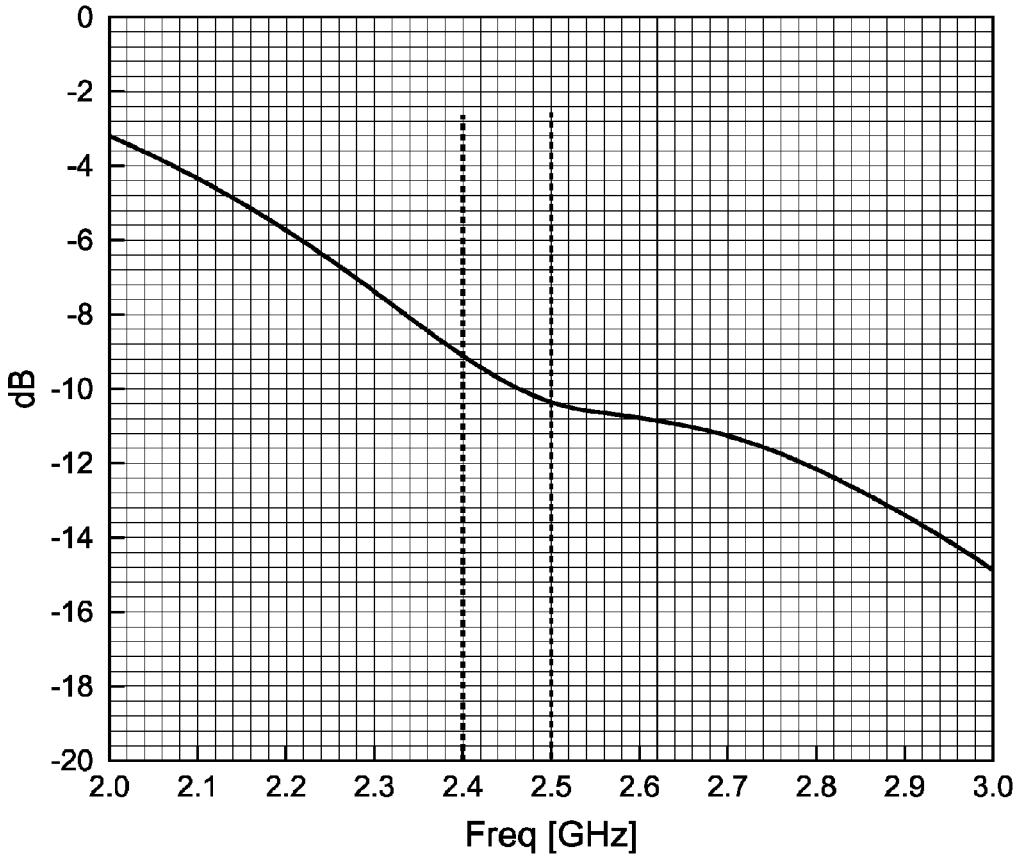
FIG. 23 shows simulation results of the isolation when C shown in FIG. 1 is further changed.

FIGS. 22 and 23 show the simulation results for the VSWR properties and isolation when C=9.0 mm, A=48.0 mm, and B=14.5 mm.

Based on these results, in all cases, VSWR is less than 3 within the range of 2.4 to 2.5 GHz, which shows that an excellent impedance match is achieved.

In cases in which C=1.5 mm and C=4.0 mm, an isolation of 10 dB or greater is achieved within the range of 2.4 to 2.5 GHz, and there is a well-defined peak. Therefore, it is possible to create a design in which the best isolation value is at 2.45 GHz. If an isolation of 10 dB or greater can be maintained, negative effects on the transmission efficiency of the antenna are negligible.

Where C=9.0 mm, it can be seen that the isolation at the lower end is less than 10 dB, and the isolation is slightly worsened (refer to FIG. 23). Unlike cases in which C=1.5 mm or C=4.0 mm, the isolation shows a downward trend, and it is difficult to have a design in which the isolation peaks at 2.45 GHz. Also, A is increased in order to improve the isolation at 2.45 GHz, which is also not desirable from a space efficiency perspective.

Therefore, it can be seen that in the multi-antenna 10 according to the present embodiment, it is not advantageous to make the distance C between the connecting portions greater than necessary, and in fact, it is preferable to make C appropriately small. In other words, unlike known antennas up until now, the gap between the elements is not directly proportional to the isolation, and is in fact inversely proportional. Therefore, in the multi-antenna 10 according to the present embodiment, high isolation properties can be achieved even when the amount of space is limited.

In the multi-antenna 10, respective elements are disposed on the same surface as each other on the substrate 11, but an antenna of similar performance can be attained whether a ground surface is present on both surfaces or only one surface. Also, the passive element and the feed elements may be disposed on the front surface, the rear surface, or an inner layer. In addition, it is possible to employ a configuration in which the respective elements formed in different layers are connected through via hole conductors.

Figure 24A:
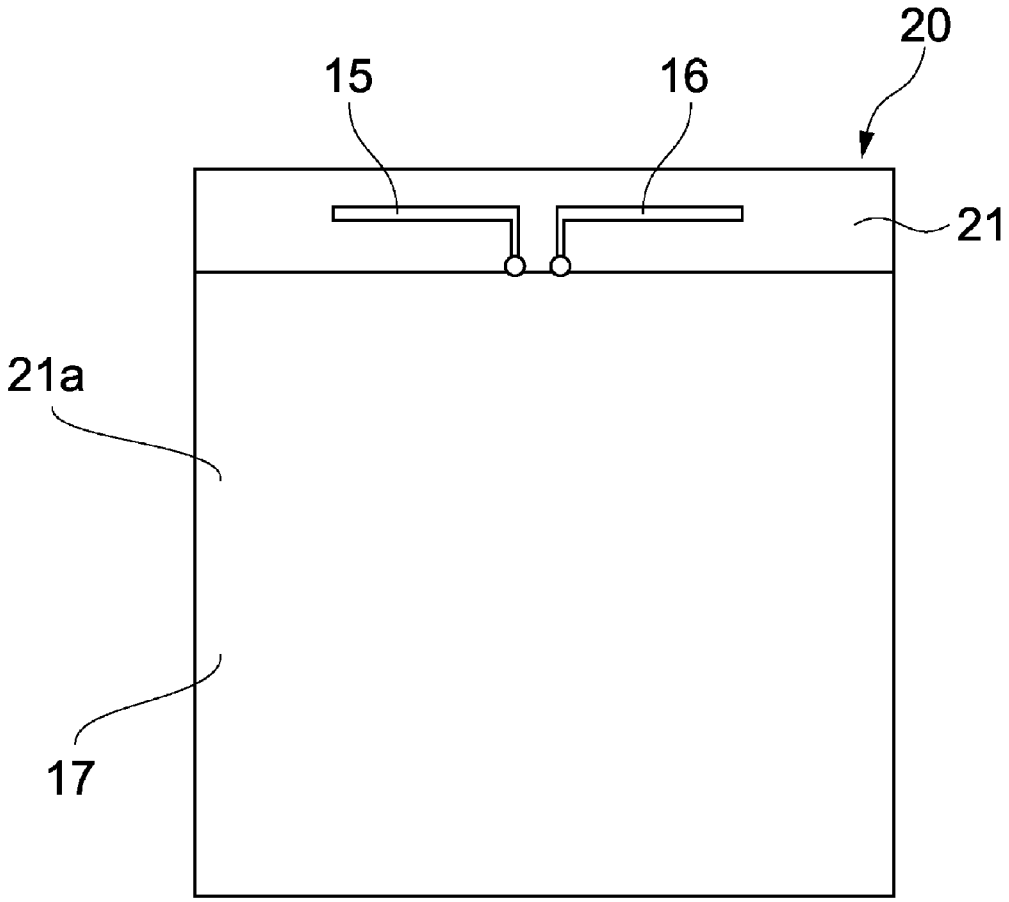
FIG. 24A is a plan view that shows one example of a multiplexed multi-antenna according to the present invention.
Figure 24B:
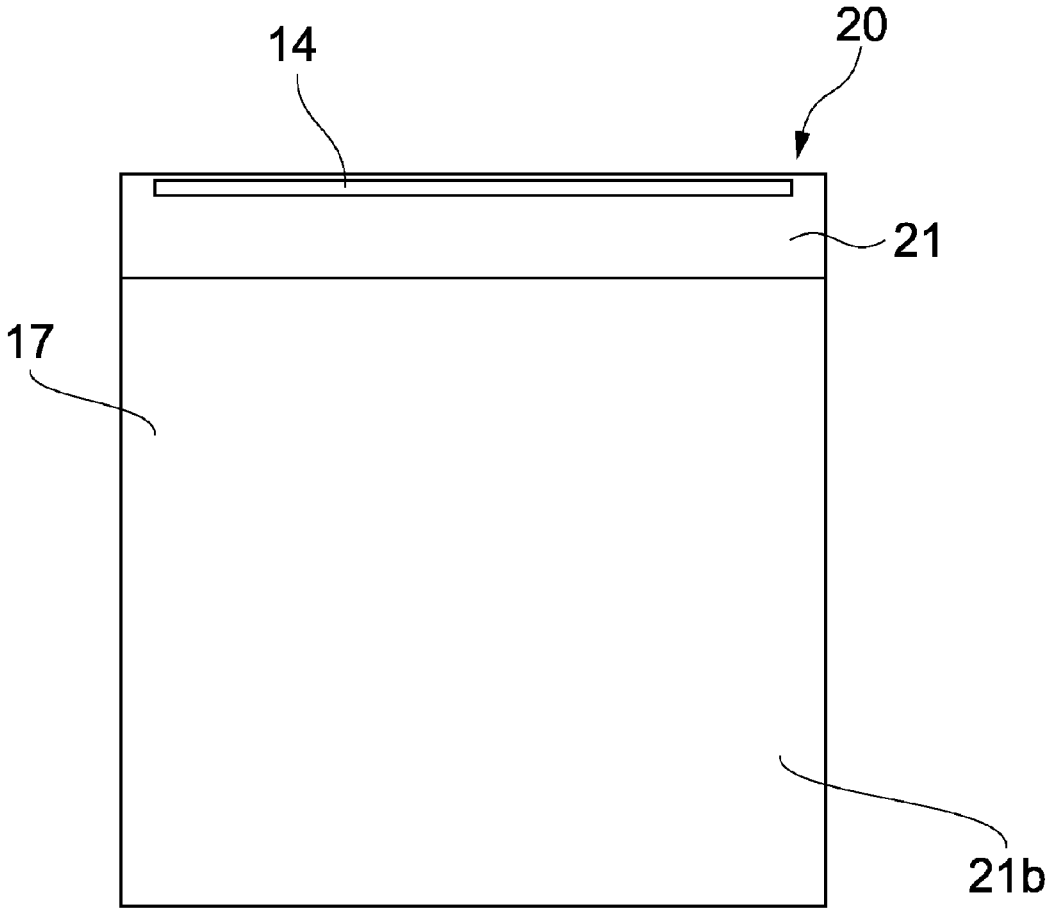
FIG. 24B is a rear view of FIG. 24A.
Figure 25A:
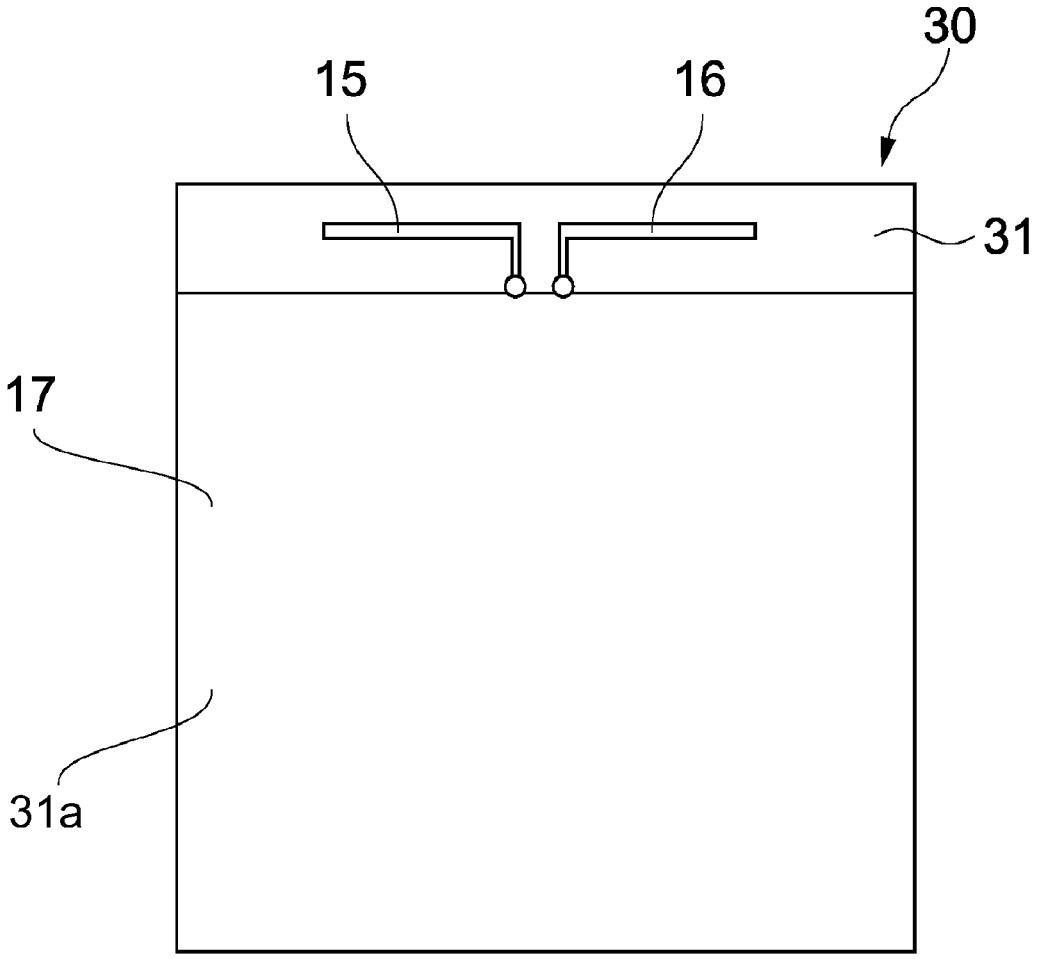
FIG. 25A is a plan view that shows another example of a multiplexed multi-antenna according to the present invention.
Figure 25B:
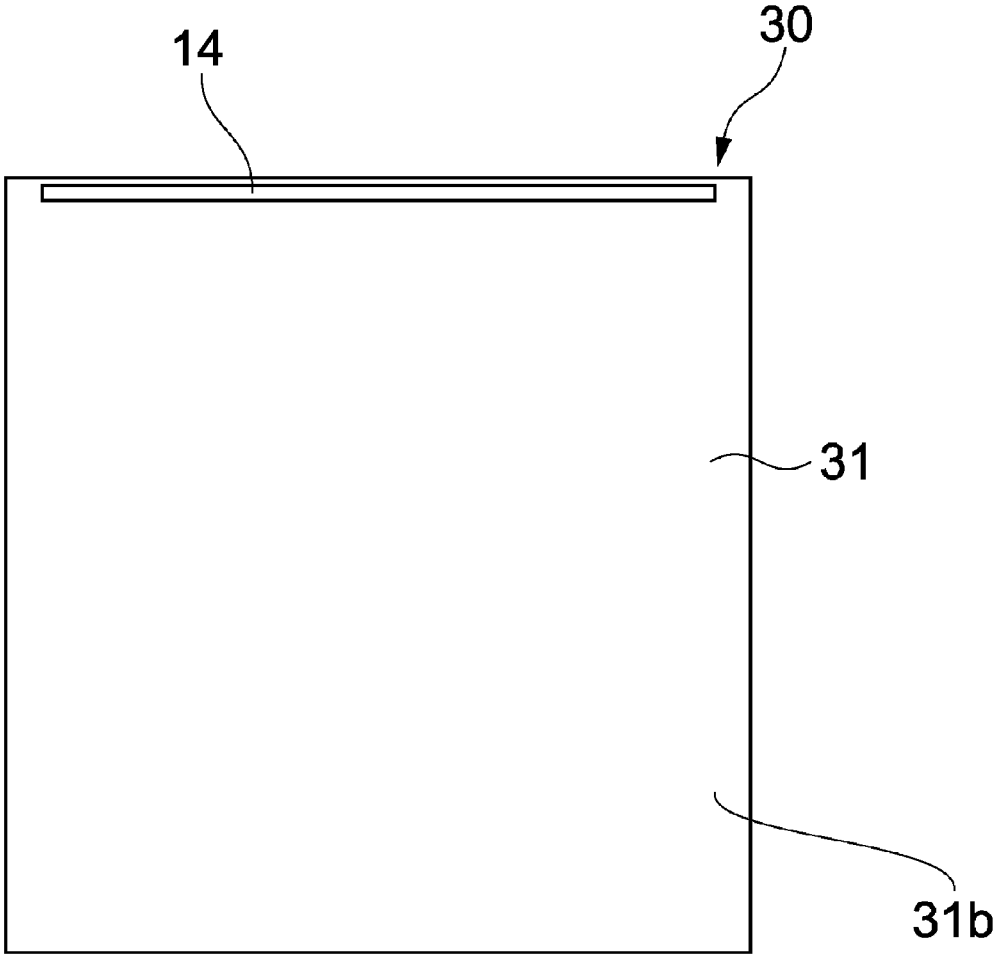
FIG. 25B is a rear view of FIG. 25A.
Figure 26A:
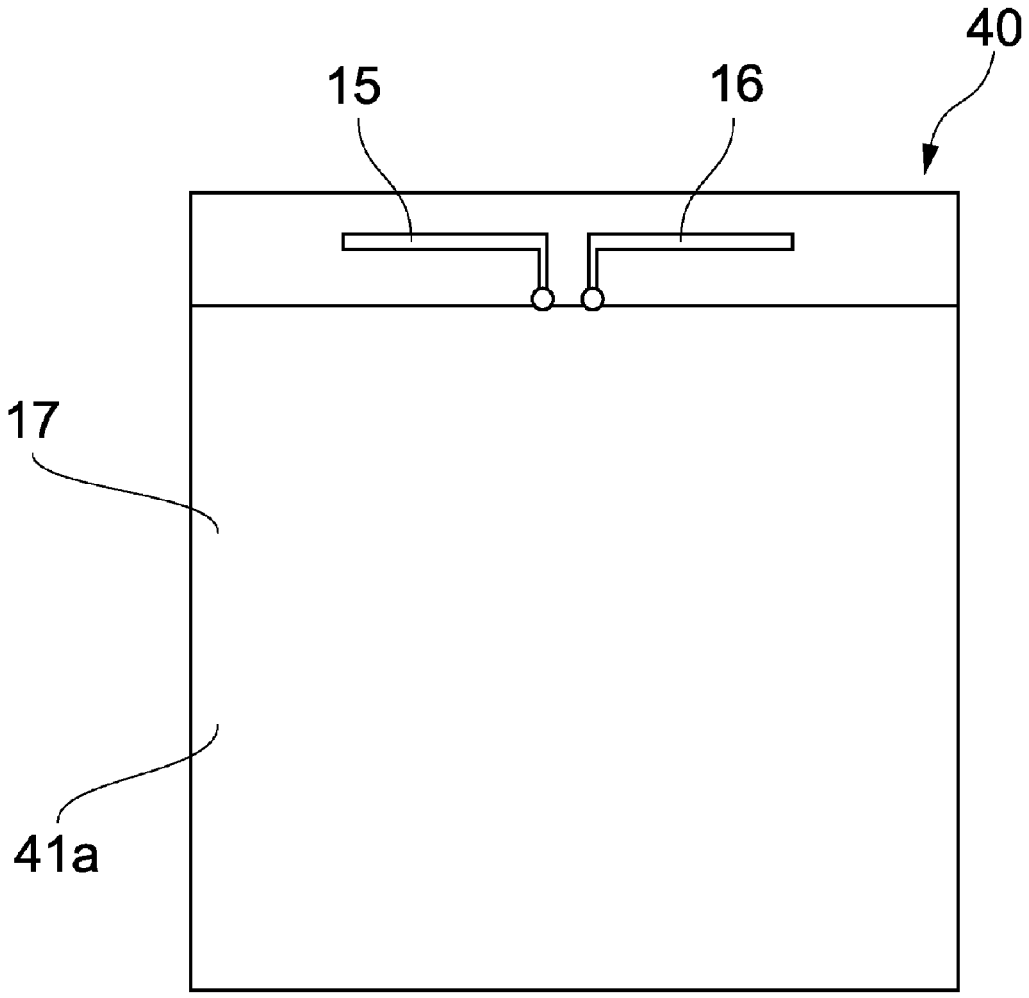
FIG. 26A is a plan view that shows another example of a multiplexed multi-antenna according to the present invention.
Figure 26B:
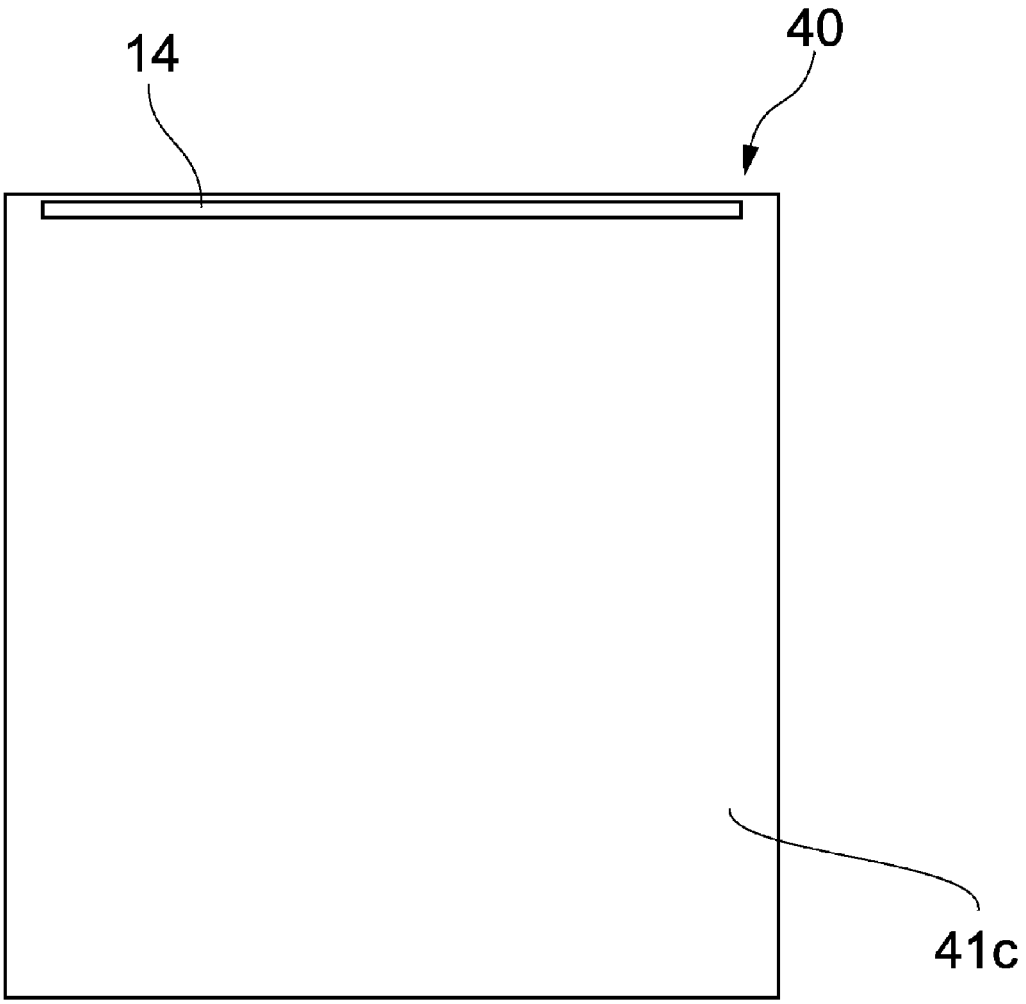
FIG. 26B is a rear view of FIG. 26A.
Figure 26C:
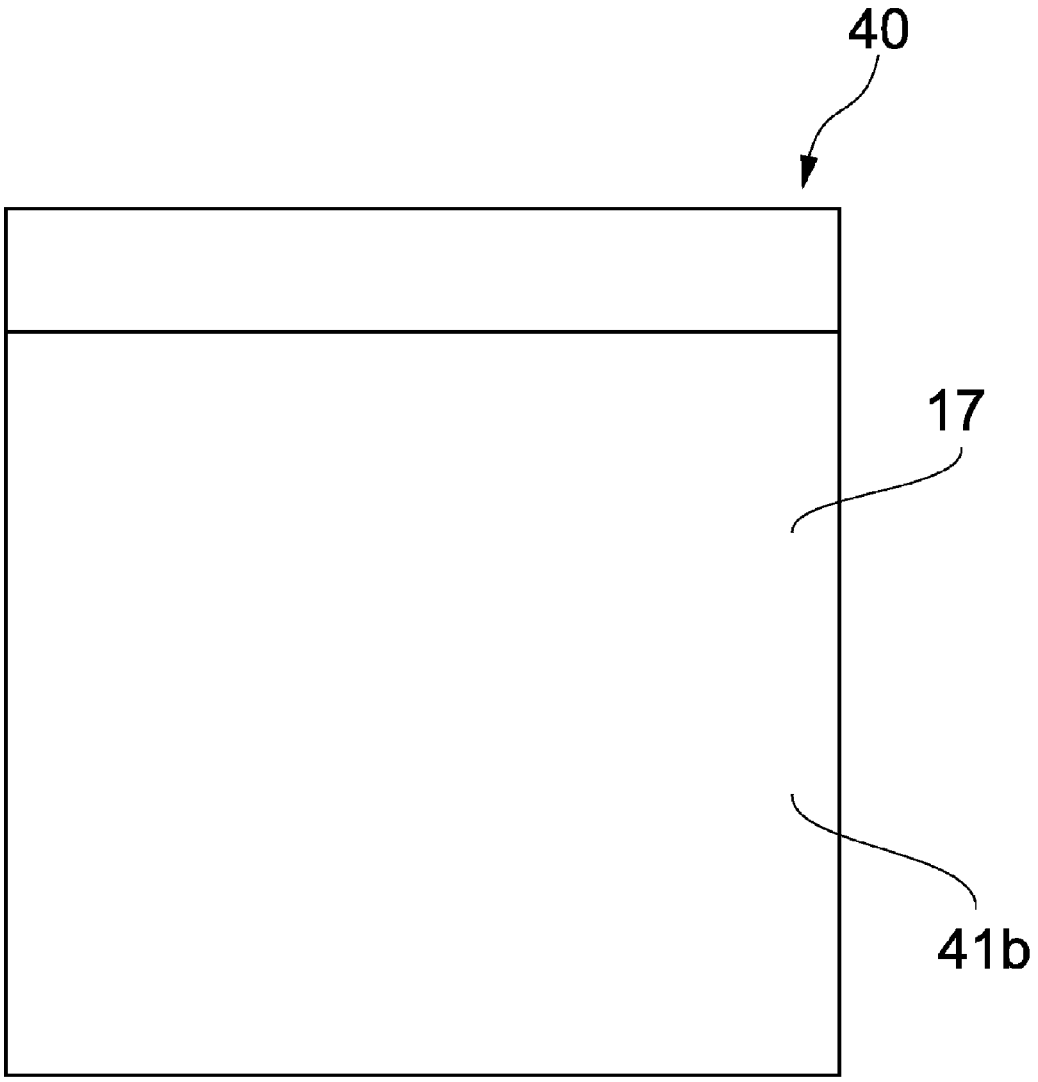
FIG. 26C is a cross-sectional view that shows an inner layer of FIG. 26A.

For example, as shown in FIGS. 24A and 24B, in the multi-antenna 20, the first and second feed elements 15 and 16 and a ground pattern 17 may be provided on the front surface 21*a* of the substrate 21, and the passive element 14 and the ground pattern 17 may be provided on the rear surface 21*b* of the substrate 21. Also, as shown in FIGS. 25A and 25B, in the multi-antenna 30, it is possible not to provide a ground pattern on the rear surface 31*b* of the substrate 31 if the front surface 31*a* is provided with a ground pattern. In addition, as shown in FIGS. 26A, 26B, and 26C, in the multi-antenna 40, an inner layer 41*c* may be provided in addition to the front and rear surfaces 41*a* and 41*b* of the substrate 41, the front surface 41*a* may be provided with the first and second feed elements 15 and 16 and the ground pattern 17, the inner layer 41*c* may be provided with the passive element 14, and the rear surface 41*b* may be provided with the ground pattern 17.

Figure 27:
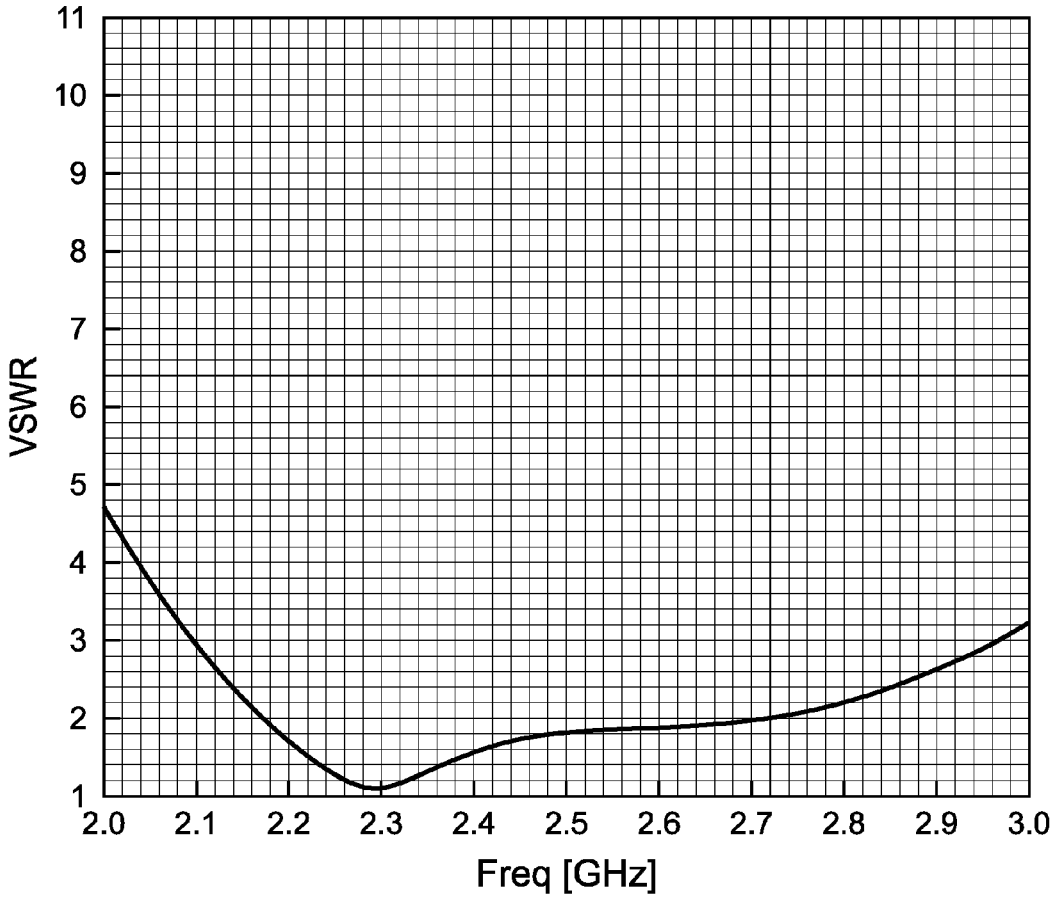
FIG. 27 shows simulation results of VSWR properties in the antenna shown in FIGS. 25A and 25B.
Figure 28:
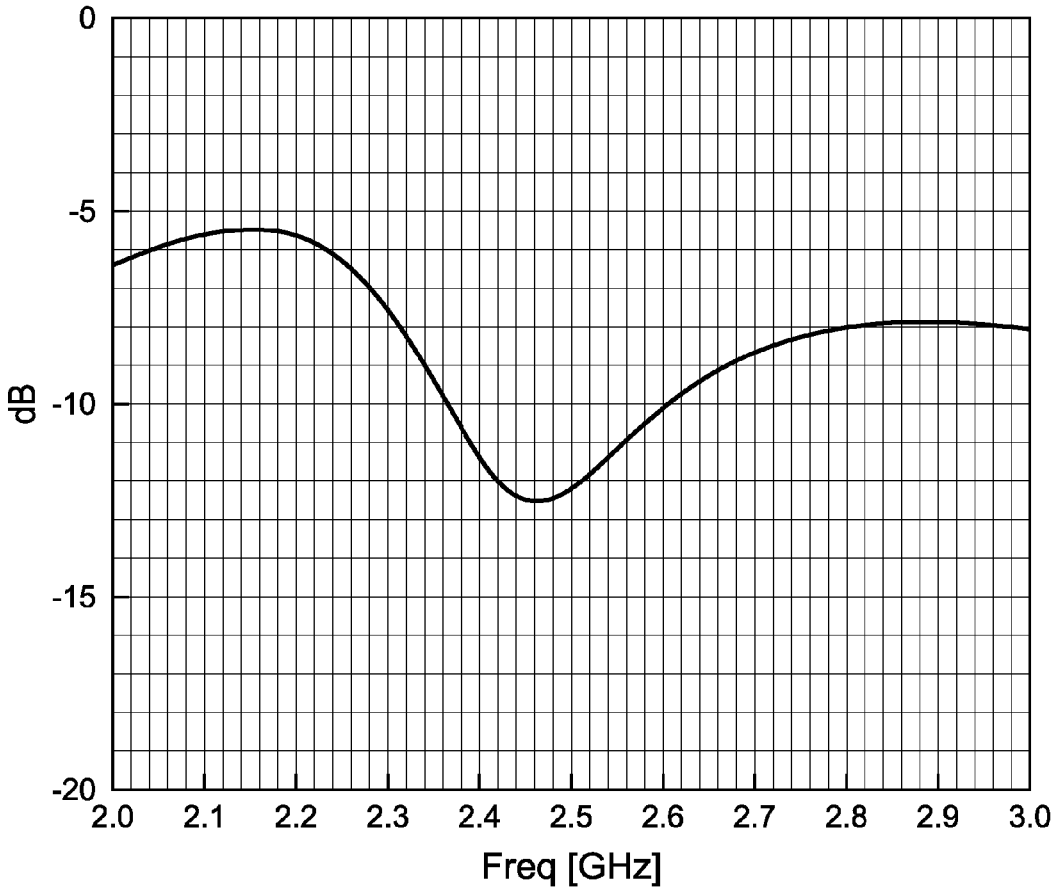
FIG. 28 shows simulation results of the isolation in the antenna shown in FIGS. 25A and 25B.

FIGS. 27 and 28 show VSWR properties and isolation of the multi-antenna 30 shown in FIG. 25. As can be seen from these drawings, similar performance can be attained compared to when each element is disposed on the same surface.

<Embodiment 2>

Next, Embodiment 2 of the present invention will be described.

Figure 29:
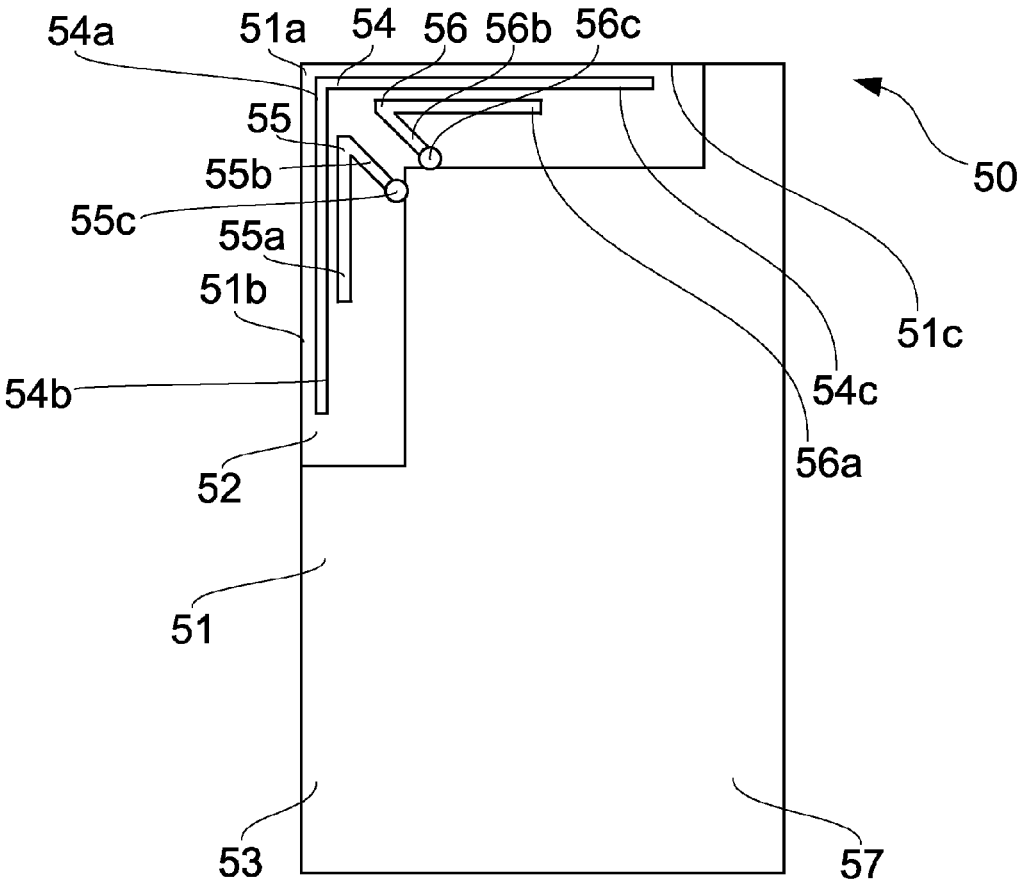
FIG. 29 is a plan view that shows a configuration of a multi-antenna according to Embodiment 2 of the present invention.

FIG. 29 is a plan view that shows a configuration of a multi-antenna according to Embodiment 2 of the present invention.

As shown in FIG. 29, a multi-antenna 50 has a rectangular substrate 51. The substrate 51 has an antenna disposal region 52 and a ground pattern disposal region 53 on a first surface. A passive element 54, a first feed element 55, and a second feed element 56 are disposed in the antenna disposal region 52. A ground pattern 57 is disposed in the ground pattern disposal region 53. Here, a switch element is disposed in the ground pattern disposal region 53, for example, but is omitted from the drawings.

The passive element 54 is a non-ground type line-shaped element with an electrical length such that a resonance mode thereof is in a target frequency band. More specifically, the passive element 54 has an electrical length of $(1/2)\cdot\lambda$, where $\lambda$ is a wavelength for the target frequency band. The center 54*a* of the passive element 54 is located at a first corner 51*a* of the rectangular substrate 51, and the passive element 54 is disposed so as to be parallel to a first side 51*b* and a second side 51*c*, which intersects orthogonally with the first side 51*b*, and so as to run along the edge of the sides 51*b* and 51*c*.

The first feed element 55 and the second feed element 56 are also line-shaped elements. The first feed element 55 has a first coupling conductive part 55*a*, and a first connecting conductive part 55*b* with a continuous shape, being at an angle of 45°, for example, to the first coupling conductive part 55*a*. The second feed element 56 has a second coupling conductive part 56*a*, and a second connecting conductive part 56*b* with a continuous shape, being at an angle of 45°, for example, to the second coupling conductive part 56*a*. The ends of the first and second connecting conductive parts 55*b* and 56*b* are provided with feed points 55*c* and 56*c*, respectively.

The first coupling conductive part 55*a* is formed so as to connect integrally with the first connecting conductive part 55*b* in a vicinity of a location corresponding to the center 54*a* of the passive element 54, and is disposed so as to be parallel and adjacent to the passive element 54 from the center 54*a* of the passive element 54 towards the first end 54*b* of the passive element 54. In other words, the first coupling conductive part 55*a* is parallel to the first side 51*b* of the substrate 51. The second coupling conductive part 56*a* is formed so as to connect integrally with the second connecting conductive part 56*b* in a vicinity of a location corresponding to the center 54*a* of the passive element 54, and is disposed so as to be parallel and adjacent to the passive element 54 from the center 54*a* of the passive element 54 towards the second end 54*c* of the passive element 54. In other words, the second coupling conductive part 56*a* is parallel to the second side 51*c* of the substrate 51. The first connecting conductive part 55*b* and the second connecting conductive part 56*b* are disposed adjacent and parallel to each other.

The first coupling conductive part 55*a* and the second coupling conductive part 56*a* constitute a main part for capacitive coupling with the passive part 54. The first and second connecting conductive parts 55*b* and 56*b* mainly constitute feed lines between the feed points 55*c* and 56*c*, and the first coupling conductive part 55*a* and the second coupling conductive part 56*a*, respectively. The first and second feed elements 55 and 56 are capacitively coupled with the passive element 54 mainly at the first coupling conductive part 55*a* and the second coupling conductive part 56*a*, but have an electrical length that is set such that the resonance mode thereof is not in the target frequency band.

In the multi-antenna 50 of the present embodiment, aside from the effects described above, space efficiency can be increased by disposing the multi-antenna 50 so as to be concentrated in the corner 51*a* of the substrate 51. Also, because the multi-antenna has a polarization surface where the first feed element 55 and the second feed element 56 intersect orthogonally, it is possible to attain polarization diversity effects.

In the present embodiment, it is possible to have a multi-layer-structured multi-antenna, similar to Embodiment 1.

<Embodiment 3>

Next, Embodiment 3 of the present invention will be described.

Figure 30:
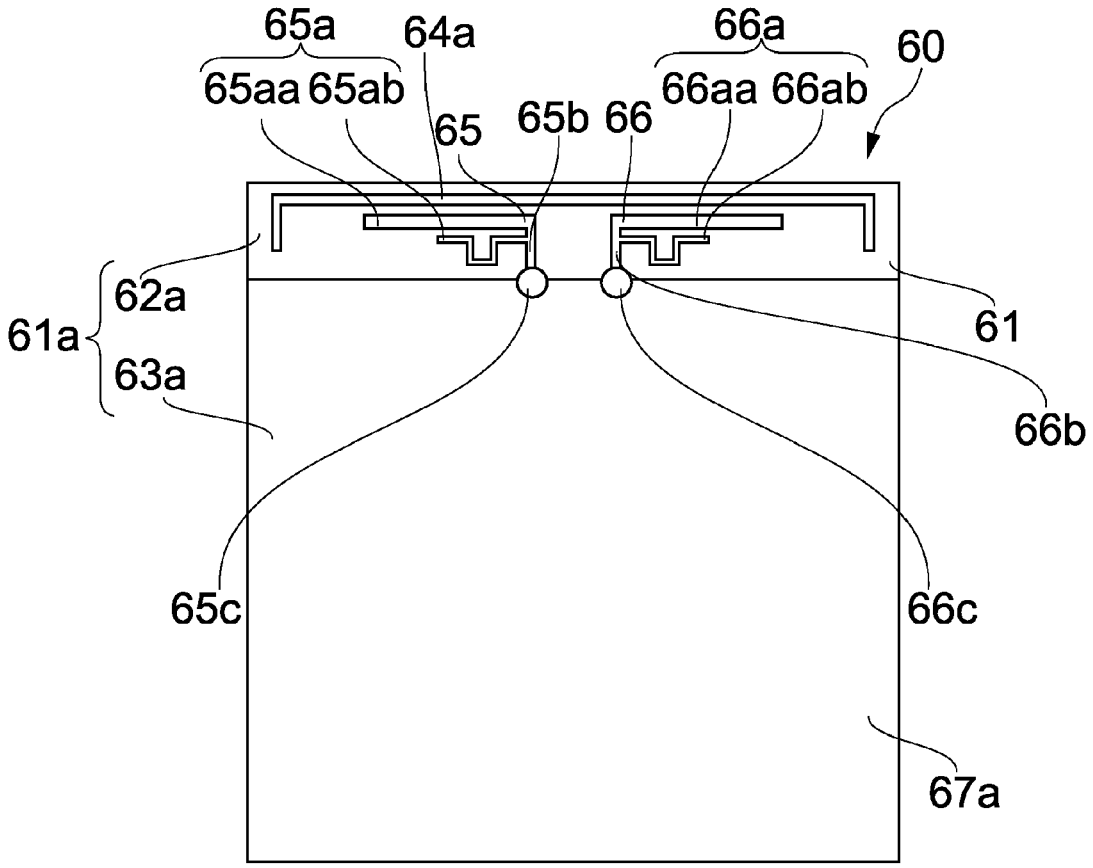
FIG. 30 is a plan view that shows a configuration of a multi-antenna according to Embodiment 3 of the present invention.
Figure 31:
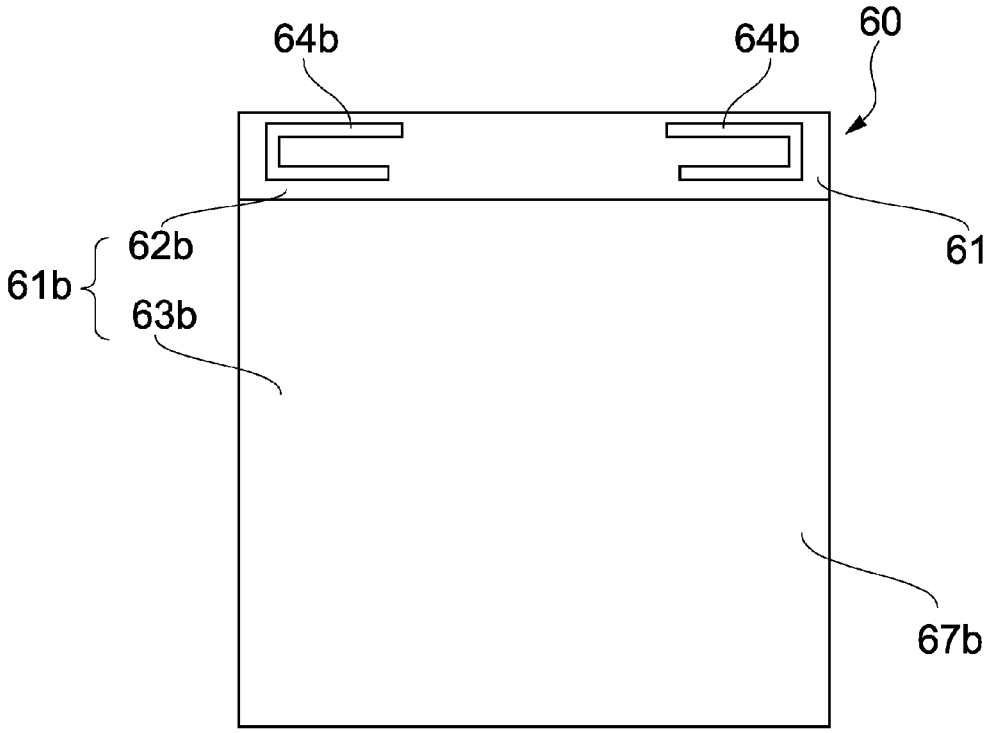
FIG. 31 is a rear view of the multi-antenna shown in FIG. 30.

FIG. 30 is a plan view that shows a configuration of a multi-antenna according to Embodiment 3 of the present invention. FIG. 31 is a rear view thereof.

As shown in FIGS. 30 and 31, a multi-antenna 60 has a rectangular substrate 61. A first surface 61*a* and a second surface 61*b* of the substrate 61 respectively have antenna disposal regions 62*a* and 62*b* and ground pattern disposal regions 63*a* and 63*b*.

The antenna disposal region 62*a* of the first surface 61*a* of the substrate 61 is provided with a first passive element 64*a*, a first feed element 65, and a second feed element 66. A ground pattern 67*a* is disposed in the ground pattern disposal region 63*a*. Here, the switch element for diversity is disposed in the ground pattern disposal region 63*a*, for example, but is omitted from drawings.

A second passive element 64*b* is disposed in the antenna disposal region 62*b* of the second surface 61*b* of the substrate 61. A ground pattern 67*b* is disposed in the ground pattern disposal region 63*b*.

The first passive element 64*a* is a non-ground type line-shaped element with an electrical length set so as to achieve a resonance mode in a first target frequency band. Here, an example of using 2.45 GHz and 5 GHz, which are two frequencies used in a wireless LAN, is described. The first passive element 64*a* is an element with an electrical length of $(1/2)\cdot\lambda_1$ where $\lambda_1$ is a wavelength at the first target frequency band. The first target frequency band is set to 2.45 GHz, for example. The first passive element 64*a* is disposed along one side of the rectangular substrate 61 and bent at 90° so as to run along respective sides adjacent to two corners of the substrate 61. In other words, by bending the passive element 64*a*, the width of the substrate 61 can be made less than the electrical length of $(1/2)\cdot\lambda_1$.

The second passive element 64*b* is a non-ground type line-shaped element with an electrical length set so as to achieve a resonance mode in a second target frequency band. More specifically, the passive element 64*b* has an electrical length of $(1/2)\cdot\lambda_2$, where $\lambda_2$ is a wavelength for the second target frequency band. The second target frequency band is set to 5 GHz, for example. Two second passive elements 64*b* are disposed at two opposite sides of the rectangular substrate 61, along the sides thereof so as to each form a shape of three sides of a rectangle. By providing this shape for the second passive elements 64*b*, the length of the substrate 61 can be kept short. Also, by providing the first and second passive elements 64*a* and 64*b* with the above-mentioned shapes, it is possible to reduce the area of the substrate 61.

The first feed element 65 and the second feed element 66 are also line-shaped elements. The first feed element 65 has a first coupling conductive part 65*a*, and a first connecting conductive part 65*b* with a continuous shape, being at an angle of 90°, for example, to the first coupling conductive part 65*a*. The second feed element 66 has a second coupling conductive part 66*a*, and a second connecting conductive part 66*b* with a continuous shape, being at an angle of 90°, for example, to the second coupling conductive part 66*a*. The ends of the first and second connecting conductive parts 65*b* and 66*b* are provided with feed points 65*c* and 66*c*, respectively.

The first coupling conductive part 65*a* has a first band conductor 65*aa* for capacitively coupling with the first passive element 64*a*, and a second band conductor 65*ab* for capacitively coupling with the second passive element 64*b*. The first band conductor 65*aa* and the second band conductor 65*ab* share the first connecting conductive part 65*b*.

The second coupling conductive part 66*a* has a first band conductor 66*aa* for capacitively coupling with the first passive element 64*a*, and a second band conductor 66*ab* for capacitively coupling with the second passive element 64*b*. The first band conductor 66*aa* and the second band conductor 66*ab* share the second connecting conductive part 66*b*.

The second band conductors 65*ab* and 66*ab* have a folded part.

The first band conductors 65*aa* and 66*aa* constitute a main part for capacitively coupling with the first passive element 64*a*. The second band conductors 65*ab* and 66*ab* constitute a main part for capacitively coupling with the second passive element 64*b*. In the first and second feed elements 65 and 66, mainly the first coupling conductive part 65*a* and the second coupling conductive part 66*a* capacitively couple with the first and second passive elements 64*a* and 64*b*, and each of the first and second feed elements 65 and 66 has an electrical length that is set such that a resonance mode thereof is not in the first or second target frequency band.

Specifically, the electrical length of the first band conductor 65*aa* and the first connecting conductive part 65*b* and the electrical length of the first band conductor 66*aa* and the second connecting conductive part 66*b* are set so as not to cause a resonance mode in the first or second target frequency band. Also, the electrical length of the second band conductor 65*ab* and the first connecting conductive part 65*b* and the electrical length of the second band conductor 66*ab* and the second connecting conductive part 66*b* are set so as not to cause a resonance mode in the first or second target frequency band.

Here, the electrical length that does not cause a resonance mode in the target frequency band is a length that is not an integer multiple of $(1/4)\cdot\lambda$, for example.

In the multi-antenna 60 configured in this way, the first and second feed elements 65 and 66 have electrical lengths such that the resonance mode thereof is not in the first or second target frequency band, and thus, a radio wave of any band emitted from one feed element does not excite the other feed element. Therefore, in any band, the presence of the other feed element does not result in loss for the one feed element, thus allowing high isolation properties to be achieved. Also, a gap between the first feed element 65 and the second feed element 66 is no longer relevant for isolation, and thus, it is possible to dispose the first feed element 65 and the second feed element 66 so as to be adjacent to each other, for example. Therefore, the multi-antenna according to the present embodiment can achieve high isolation properties without relying on space.

Figure 32:
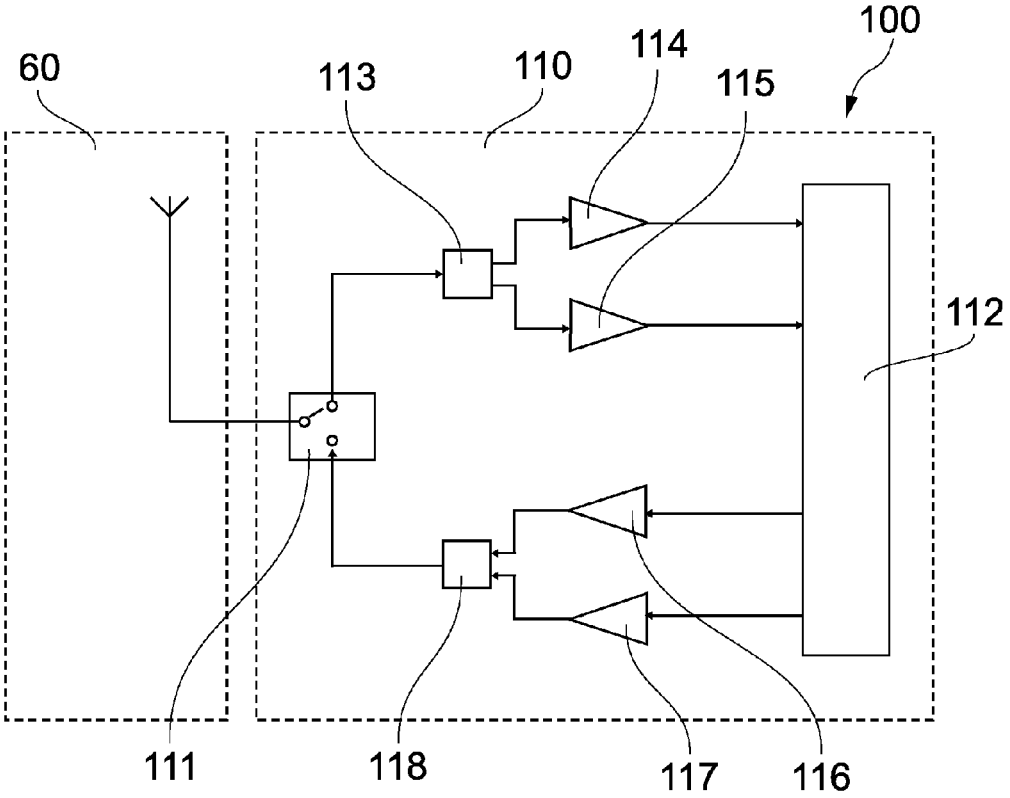
FIG. 32 is a block diagram that shows a configuration of an electronic device according to an embodiment of the present invention.

Here, an example in which the multi-antenna 60 according to the present embodiment is applied to a dual band wireless LAN broadband router at 2.4 GHz/5 GHz bands as an electronic device is shown in FIG. 32.

As shown in FIG. 32, such an electronic device 100 is configured such that a high frequency circuit 110 is connected to the multi-antenna 60. The high frequency circuit 110 has a transmission/reception selection switch 111 and a transceiver IC 112. As for the receiving-side path, a signal from the transmission/reception selection switch 111 is transmitted through a receiving diplexer 113, a 2.4 GHz receiving low noise amp 114, or a 5 GHz receiving low noise amp 115, and is inputted into the transceiver IC 112. As for the transmitting-side path, a signal from the transceiver IC 112 is transmitted through a 2.4 GHz transmitting amp 116 or a 5 GHz transmitting amp 117, and a transmitting diplexer 118, and is inputted into the transmission/reception selection switch 111. The multi-antenna 60 includes a diversity switch, but this is not shown in the drawings.

Because the electronic device described above has a dual-type multi-antenna 60 that can achieve high isolation properties without relying on space, the device can be miniaturized and the transmitting and receiving performance are also high.

<Other Embodiments>

The present invention is not limited to the above embodiments, and various modifications can be made within the scope of the technical spirit of the present invention, such modifications also falling within the technical scope of the present invention.

Figure 33:
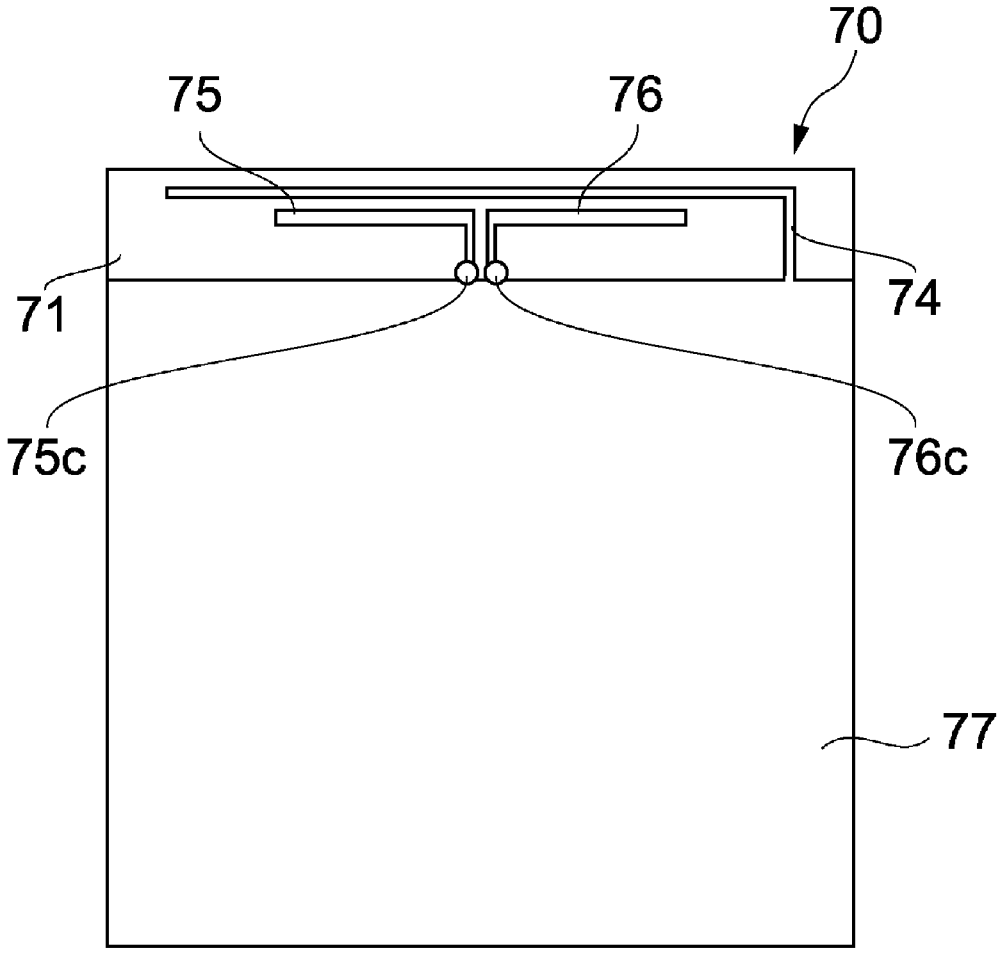
FIG. 33 is a plan view of a multi-antenna according to a modified example of the present invention.

For example, in the embodiments above, a case in which the electrical length of the passive element is $(1/2)\cdot\lambda$ was described, but as shown in FIG. 33, for example, a multi-antenna 70 with a monopole ground-type passive element 74 with an electrical length of $(1/4)\cdot\lambda$ may be configured. In FIG. 33, 71 is a substrate, 75 is a first feed element, 76 is a second feed element, 77 is a ground pattern, and 75*c* and 76*c* are feed points.

In the embodiments above, embodiments in which the present invention is applied to a diversity antenna for a wireless LAN was described, but the multi-antenna of the present invention can of course be applied to other systems such as MIMO in which a plurality of antennas are used. For example, the present invention is not limited to the wireless LAN 2.45/5 GHz bands, and can be used for systems that use other frequencies such as mobile telephones. In such a case, similar operations can of course be conducted by adjusting the dimensions of each part of the antenna according to the wavelength.

It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A multi-antenna, comprising:

a passive element with an electrical length such that a resonance mode thereof is in a target frequency band; and first and second feed elements, each of the first and second feed elements having an electrical length such that each of the first and second feed elements does not resonate in said target frequency band, the first and second feed elements being capacitively coupled with the passive element.

2. The multi-antenna according to claim 1, wherein the passive element is a non-ground type, wherein the first feed element includes a first coupling conductive part and a first connecting conductive part that is continuous to the first coupling conductive part and connected to a first feed point, the first coupling conductive part being capacitively coupled with the passive element and meeting at an angle with the first connecting conductive part, and wherein the second feed element includes a second coupling conductive part and a second connecting conductive part that is continuous to the second coupling conductive part and connected to a second feed point, the second coupling conductive part being capacitively coupled with the passive element in a location different from capacitive coupling of the first connecting conductive part and meeting at an angle with the second connecting conductive part disposed adjacent to the first connecting conductive part.

3. The multi-antenna according to claim 2, wherein the passive element is a line-shaped conductor, and wherein in the first and second feed elements, the first coupling conductive part is connected to the first connecting conductive part adjacent to a center of the passive element and disposed so as to be parallel to the passive element, the second coupling conductive part is connected to the second connecting conductive part adjacent to said center of the passive element and disposed so as to be parallel to the passive element, the first connecting conductive part and the second connecting conductive part being disposed so as to be adjacent and parallel to each other and being at said angle respectively to the first coupling conductive part and the second coupling conductive part.

4. The multi-antenna according to claim 3, comprising a rectangular substrate with the passive element mounted thereon, wherein, in the passive element, the center is located adjacent to a first corner of the rectangular substrate, and the passive element has a first part parallel to a first side of the substrate and a second part parallel to a second side that intersects orthogonally with the first side, wherein the first coupling conductive part is disposed so as to be parallel to the first side of the substrate, and wherein the second coupling conductive part is disposed so as to be parallel to the second side of the substrate.

5. A multi-antenna, comprising:

a first passive element with an electrical length such that a resonance mode thereof is in a first target frequency band;

a second passive element with an electrical length such that a resonance mode is in a second target frequency band; and first and second feed elements, each of the first and second feed elements having an electrical length such that each of the first and second feed elements does not resonate in the first target frequency band and does not resonate in the second target frequency band, the first and second feed elements being capacitively coupled with the first and second passive elements.

6. The multi-antenna according to claim 5, further comprising a substrate that has the first passive element and the first and second feed elements mounted on a first surface thereof and that has the second passive element mounted on a second surface thereof.

7. An electronic device comprising:

a multi-antenna having a passive element at an electrical length such that a resonance mode thereof is in a target frequency band, and first and second feed elements, each of which has an electrical length such that each of the first and second feed elements does not resonate in the target frequency band, each of the first and second feed elements being capacitively coupled with the passive element; and a high frequency circuit connected to the first and second feed elements.

8. The multi-antenna according to claim 2, wherein the first connecting conductive part of the first feed element and the second connecting conductive part of the second feed element are disposed so as to oppose to each other without any intervening element therebetween.

* * * * *